US005676588A

United States Patent [19]

Frederick et al.

[11] Patent Number: 5,676,588

[45] Date of Patent: Oct. 14, 1997

[54] ROTATING DRUM CRYOGEN SHOT BLAST DEFLASHING SYSTEM

[75] Inventors: William R. Frederick, Valley View; Michael Hjerpe, Lorain, both of Ohio

[73] Assignee: AGA AB, Lidingo, Sweden

[21] Appl. No.: 542,447

[22] Filed: Oct. 12, 1995

[51] Int. Cl.[6] ..... B24C 3/30

[52] U.S. Cl. ..... 451/86; 451/85; 451/75; 451/89

[58] Field of Search ..... 451/75, 53, 85–89, 451/102, 91

[56] References Cited

U.S. PATENT DOCUMENTS

| | | | |
|---|---|---|---|
| 4,047,334 | 9/1977 | Kuehn | 451/85 |
| 4,312,156 | 1/1982 | McWhorter | 451/53 |
| 4,519,812 | 5/1985 | Brull et al. | 51/422 |
| 4,524,548 | 6/1985 | Klee et al. | 451/53 |
| 4,598,501 | 7/1986 | Vasek | 451/86 |
| 4,646,484 | 3/1987 | Brull | 51/436 |
| 4,648,214 | 3/1987 | Brull et al. | 51/410 |
| 4,793,103 | 12/1988 | Baumgart | 451/53 |
| 4,979,338 | 12/1990 | Schmitz et al. | 451/86 |

*Primary Examiner*—James G. Smith
*Assistant Examiner*—Dona C. Edwards
*Attorney, Agent, or Firm*—Pearne, Gordon, McCoy & Granger LLP

[57] ABSTRACT

A cryogen shot blast system is provided which includes a sealed cryogenic chamber and a barrel which is supported within the cryogenic chamber and is rotatable about a longitudinal axis. The barrel is pivotally mounted so that the longitudinal axis of the barrel has a variable angle of inclination. The cryogenic chamber includes a drum portion and a generally hemispherically-shaped dome portion which seals an open end of the drum portion. The cryogenic chamber is jointed such that the barrel and a portion of the cryogenic chamber can rotate between a loading position wherein work pieces can be loaded into the barrel and an operating position wherein the barrel is sealed within the cryogenic chamber. A throwing wheel propels particulate media into the barrel to impact work pieces. A nozzle injects the particulate media at different orientations within the throwing wheel to vary the direction of flow of particulate media from the throwing wheel.

21 Claims, 16 Drawing Sheets

ROTATING DRUM CRYOGEN SHOT BLAST DEFLASHING SYSTEM

BACKGROUND OF THE INVENTION

1. Field of the Invention

The present invention generally relates to a cryogen shot blast system and, more specifically, to a cryogen shot blast system having a rotating barrel within a sealed cryogen chamber which rotates between a loading position and an unloading position.

2. Description of Related Art

Molded articles often have thin pieces of unwanted material extending therefrom called "flash" which must be removed from the articles for the articles to reach their desired final configuration. Removing flash from articles formed from flexible materials such as rubber, plastics, and the like, is difficult in view of the soft, elastic nature of the flexible materials. While various types of mechanical trimming operations have been proposed for use in removing unwanted flash, these methods have proven to be not economical in a number of applications.

In order to simplify and reduce the cost of flash removal, various attempts have been made for freezing or otherwise cooling molded articles to embrittle the thin sectioned flash, whereafter one or a combination of mechanical processes have been utilized to break-off, trim, or otherwise remove the frozen or embrittled flash. Some of these methods have utilized a two-stage process wherein the work pieces to be deflashed are cooled in a first stage to effect flash embrittlement, whereafter the work pieces are vibrated, tumbled, or otherwise mechanically treated in a second stage to break away or otherwise remove the embrittled flash. One method is to use a cryogen material, such as liquid nitrogen, to effect embrittlement of the work piece flash. As utilized herein, the term "cryogen" will be understood to refer broadly to substances which are fluids and are at temperatures of about −60 F. and below.

Two-stage processes of this type are undesirable from several viewpoints. They are time consuming to carry out because cooling the work pieces and removing their flash comprise separate steps that are carried out sequentially rather than concurrently. Inasmuch as the work pieces are cooled only once and will not be cooled again at other stages of the flash removal procedure, adequate time must be devoted at the outset to providing a thorough cooling of the work pieces to assure that they are refrigerated to an extent that their flash will remain embrittled throughout the remainder of the flash removal process. Sometimes the extensive degree of the refrigeration which is required at the outset of such a two-stage process results in the generation of undesirable stresses and/or the formation of cracks or other types of structural defects in the work pieces.

An equally troubling drawback of the two-stage processes is that, if there is a relatively large quantity flash to be removed, the degree of refrigeration provided in the initial cooling stage may not be sufficient to keep the work pieces adequately embrittled during the entire time required for deflashing. Where such is the case, the work pieces have not been properly deflashed when the two-stage process has drawn to a close.

One method of removing the embrittled flash has been shot blast deflashing machinery in both single and plural stage processes. See, for example, U.S. Pat. No. 4,648,214, which discloses a single stage cryogen shot blasting system.

Previous cryogen shot blast deflashing apparatus, however, have been characterized by a number of drawbacks. The apparatus typically have been of complex and expensive construction, and have exhibited less than the desired degree of reliability. The systems typically withdraw particulate including media and pieces of flash from treatment chambers, segregate reusable media, return the reusable media to throwing wheels. In short, most previous cryogen shot blast deflashing apparatus have been quite costly to build, costly to maintain, and costly to operate; moreover, their operation has been undependable in that it has been characterized by undesirable frequent and lengthy intervals of down time.

Still other drawbacks of the cryogen shot blast systems have related to the inabilities of these systems to provide for adequate adjustment of various operating parameters throughout sufficiently wide ranges of control so that a needed variety of shot blast deflashing operations can be performed. Stated another way, previously proposed apparatus have suffered from a pronounced lack of versatility. Furthermore, the apparatus have been relatively inefficient in that a relatively long period of time is required to deflash the work pieces. Accordingly, there is a need in the art for an improved cryogen shot blast deflashing system.

SUMMARY OF THE INVENTION

The present invention provides a cryogen shot blast apparatus which overcomes at least some of the above-described problems of the related art. The apparatus includes a sealed cryogenic chamber and a barrel supported within the cryogenic chamber which is rotatable about a longitudinal axis. The barrel has an open end and defines a treatment chamber for work pieces to be deflashed. A cryogen supply introduces a flow of cryogen into the treatment chamber for embrittling at least selected portions of the work pieces in the treatment chamber and a throwing wheel propels particulate media into the treatment chamber to impact the work pieces. The apparatus also includes a cryogen recirculation system which has a return conduit in communication with the treatment chamber for withdrawing cryogen gas from the treatment chamber and a supply conduit in communication with the throwing wheel for redelivering pressurized cryogen gas to the throwing wheel. A blower withdraws the cryogen gas from the treatment chamber through the return conduit, pressurizes the cryogen gas, and returns pressurized cryogen gas to the treatment chamber through the supply conduit and the throwing wheel. A metered flow of particulate media is introduced into the flow of cryogen gas in the supply conduit to transport the same from a supply of particulate media to the throwing wheel. Reusable media is withdrawn from the treatment chamber and reintroduced into the flow of cryogen gas to again transport the same therewith to the throwing wheel.

In a preferred embodiment, the cryogen chamber includes a drum portion and a hemisperically-shaped dome portion which seals an open end of the drum portion. The cryogenic chamber is jointed such that the barrel along with a portion of the cryogenic chamber is rotated between a loading position wherein the work pieces can be introduced into the barrel through the open end and an operating position wherein the barrel is sealed within the cryogenic chamber. Preferably, the angle of inclination of the barrel and the direction of the flow of particulate media can be simultaneously varied as the barrel rotates in order to substantially reduce the duration of the deflashing operation.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
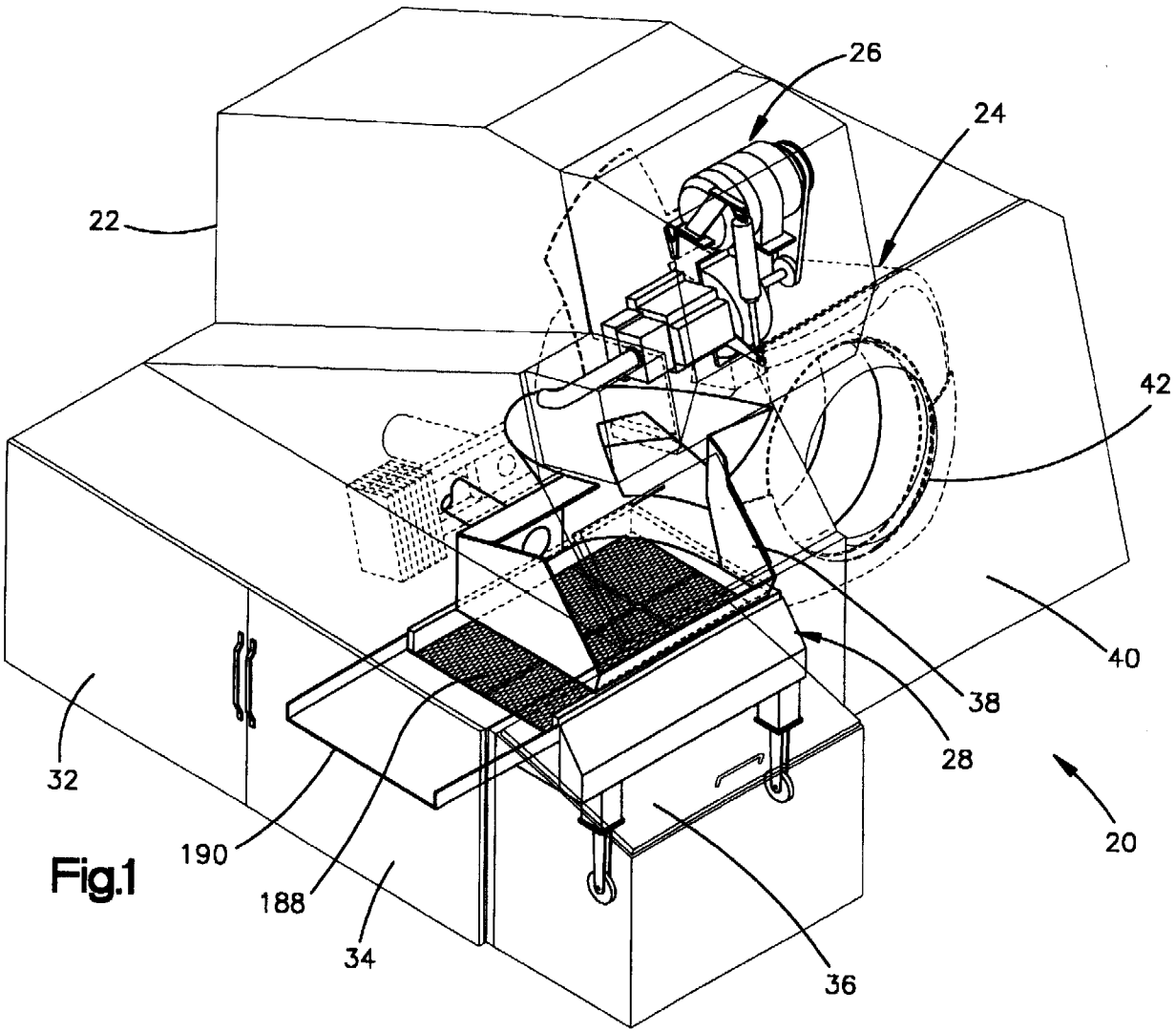
FIG. 1 is a perspective view of a cryogen shot blast deflashing system according to the present invention.

FIG. 1 illustrates a cryogen shot blast deflashing apparatus 20 incorporating the present invention. The apparatus 20 includes a cabinet 22, receptacle assembly 24, a throwing wheel assembly 26, and a closed recirculation system 28. The cabinet 22 is formed by frame structure 30 (FIG. 2) of carbon steel square tubing which is enclosed by a plurality of steel panels 31 and access doors. Preferably, a media bin door 32, a work piece hopper door 34, a flash hopper door 36, a drop chute door 38, a main front door 40, and a main rear door 41 (FIG. 2) are provided. Within the main front door 40 is an opening 42 for loading work pieces. As best shown in FIG. 3, a loading door 44 is provided which has an open portion 46 which allows loading of the work pieces through the opening 42 and a closed portion 48 which allows the opening 42 to be closed. The loading door 44 pivots to place either the closed portion 48 or the open portion 46 over the opening 42 in response to a linear magnetic actuator 50. Each of the doors are preferably sealed with refrigerator-type gaskets.

Figure 2:
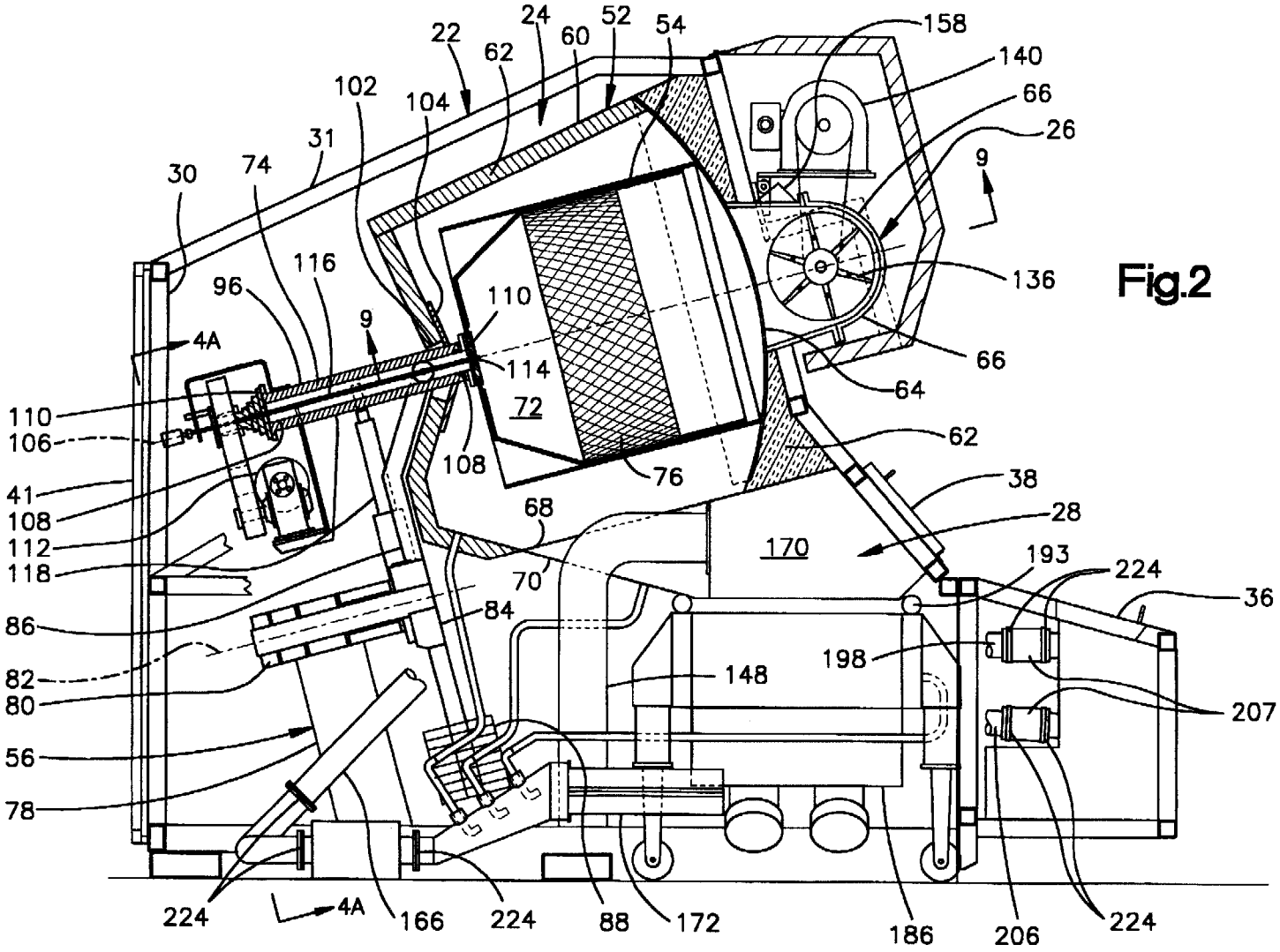
FIG. 2 is a side elevation view, in partial cross-section, of the apparatus of FIG. 1 with elements removed for clarity and with a rotating barrel in an operating position.
Figure 3:
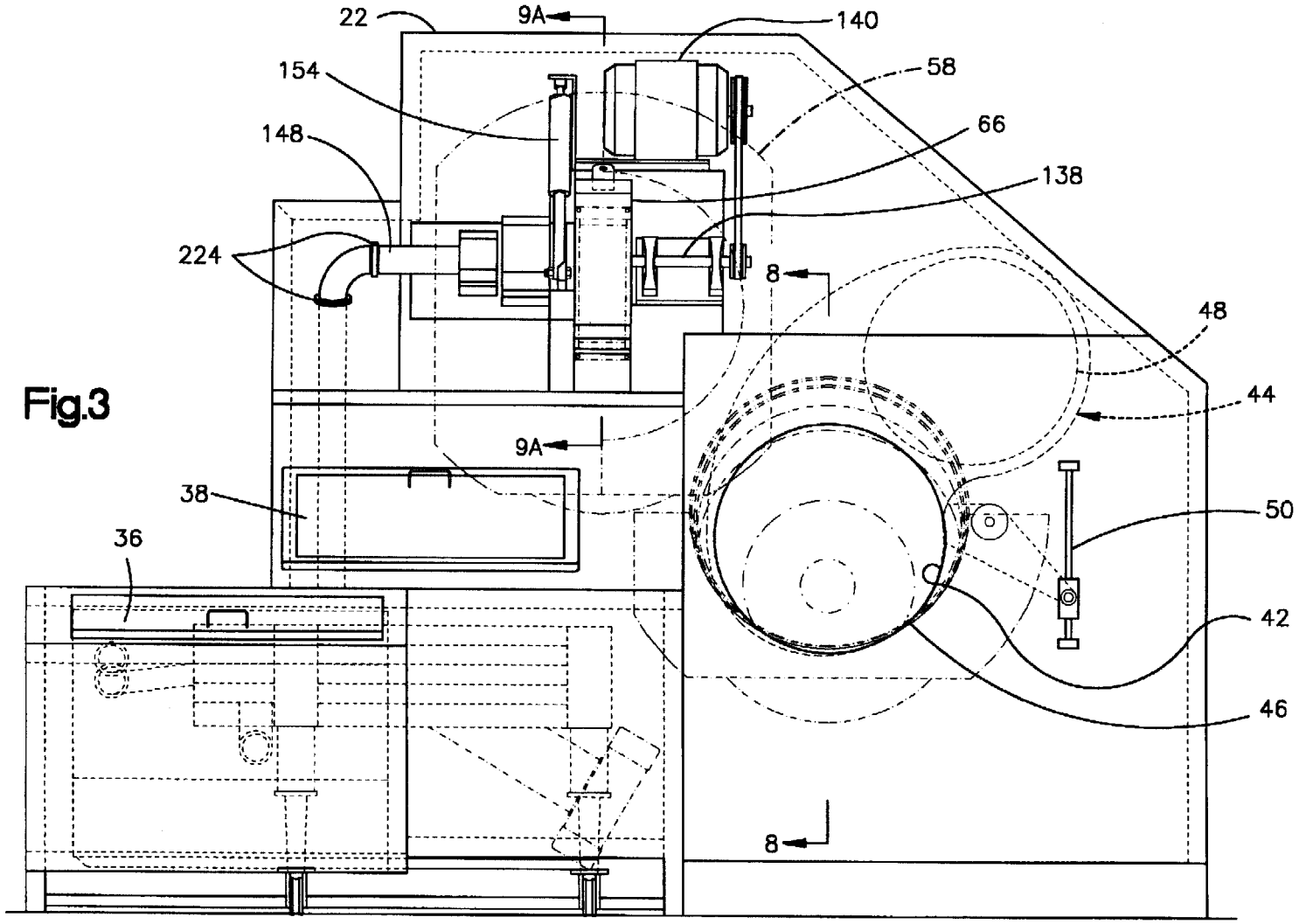
FIG. 3 is a front elevational view of the apparatus of FIG. 1 with a throwing wheel cover removed for clarity.

As best shown in FIG. 2, the receptacle assembly 24 includes a sealed cryogenic chamber 52, a rotating barrel 54, and a support structure 56. The cryogenic chamber 52 includes a generally hemispherically-shaped dome portion 58 and a drum portion 60. The dome portion 58 is preferably formed from aluminum and is supported by the front wall of the cabinet 22. Space between the dome portion 58 and the cabinet 22 is preferably filled with polyurethane foam insulation 62. Formed at the center of the dome portion 58 is a rectangularly-shaped opening 64 for the throwing wheel assembly 26. The opening 64 is sealed by a throwing wheel housing 66. A slip joint is provided between the housing 66 and the dome portion 58 to accommodate relative movement therebetween due to thermal expansion and contraction. As best shown in FIG. 3, the dome portion 58 preferably has generally vertical sides.

As best shown in FIG. 2, the drum portion 60 is generally frusto-conically shaped with a closed small diameter end and an open large diameter end. The rearward end of the drum portion 60 is supported by the support assembly 56 such that the forward open end engages the inner surface dome portion 58. It is noted that the forward end surface of the drum portion 60 is shaped to conform with the curvature of the inner surface of the dome portion 58. Formed in this manner, the cryogenic chamber 52 is sealed without the use of cryogenic seals or gaskets which require relatively frequent replacement. It is noted that while the cryogenic chamber is sealed to a degree required for operation of the apparatus 20, the cryogen chamber 52 is not considered to be a pressure vessel. At the bottom of the drum portion 60 is an opening 68 which opens into a drop chute 70. The opening 68 is sealed by the drop chute 70 which in turn opens into the closed recirculation system 28. A slip joint is provided between the drop chute 70 and the drum portion 60 to accommodate relative movement therebetween due to thermal expansion and contraction. The bottom inner surface of the drum portion 60 is angled downwardly in a forward direction toward the downwardly angled drop chute 70 so that a downwardly angled surface is provided without interruption. The drum portion 60 is of a double-wall type, that is, the drum portion 60 has two spaced apart walls preferably formed of aluminum. The space between the walls is filled with a polyurethane foam insulation 62.

The rotating barrel 54 is generally cylindrically shaped with a closed end and a open end and forms a work piece treatment chamber 72 therein. The barrel 54 is supported within the cryogenic chamber 52 by a shaft 74 fixed to the closed end of the barrel 54. The open end of the barrel 54 is adjacent the dome portion 58 of the cryogenic chamber 52 to generally close the open end of the barrel 54 to have a closed work piece treatment chamber 72. The side wall of barrel 54 includes perforations or openings 76 such that the interior of the barrel 54 is in communication with the interior of the cryogenic chamber 52. The barrel 54 is preferably made from stainless steel. It is noted that the barrel 54 is easily removable by removing mechanical fasteners so that interchangeable barrels of different diameters but of the same length can be utilized for different deflashing operations.

Figure 4A:
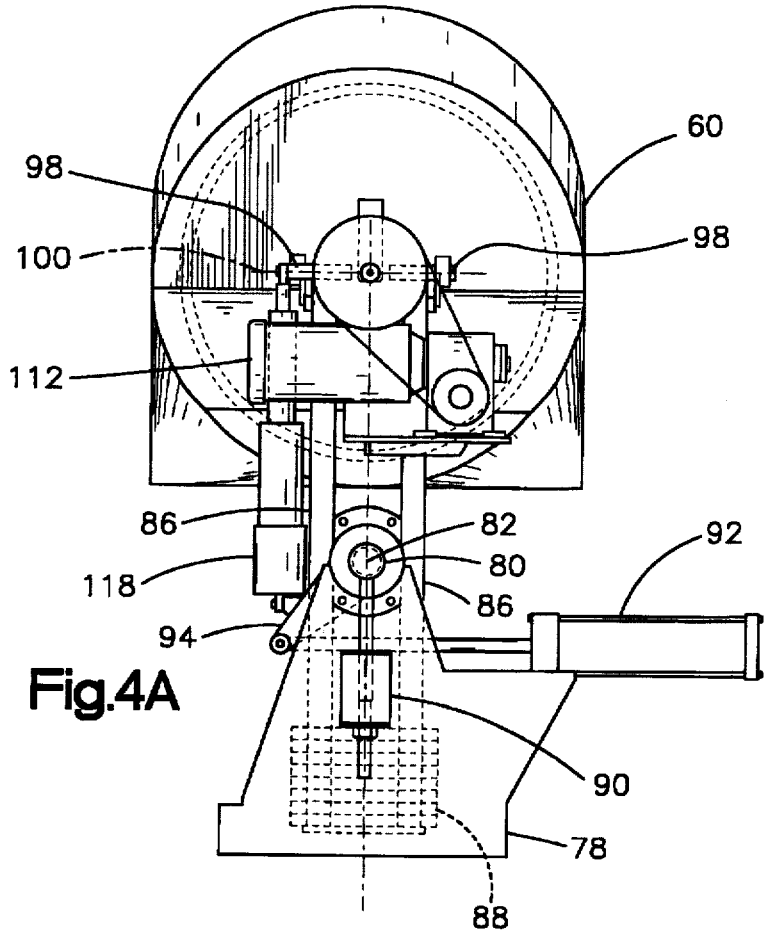
FIG. 4A is an enlarged rear elevation view of a support structure in an operating position taken along line 4A—4A in FIG. 2.
Figure 4B:
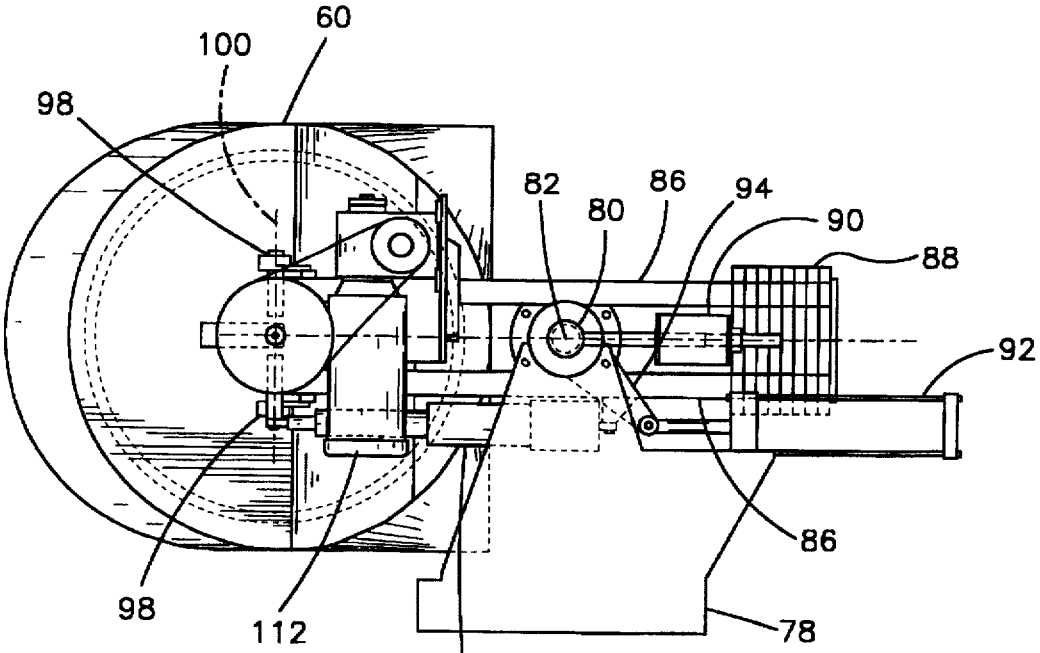
FIG. 4B is an enlarged rear elevation view of the support structure, similar to FIG. 4A, but in a loading position.

As best shown in FIGS. 2, the support structure 56 includes a base 78 which supports a rotating shaft 80 having an axis of rotation 82 which inclines upwardly in a forward direction at an angle of about 15 degrees. A hub 84 is provided at the forward end of the shaft 80, from which extend a pair of parallel arm members 86 substantially perpendicular to the rotational axis 82. The drum portion 60 of the cryogenic chamber 52 is attached to and supported by an upper end of the arm members 86. Counterweights 88 are carried by a lower end of the arm members 86 to balance the support assembly 56 as the shaft 80 is rotated. Additionally, a variable counterweight 90 (FIGS. 4A and 4B) perpendicularly extends from the rearward end of the shaft 80. As best shown in FIGS. 4A and 4B, a linear actuator or pneumatic cylinder 92 is provided to rotate the shaft 80. The linear actuator 92 is supported by the base 78 such that the direction of motion of the linear actuator 92 is generally horizontal and offset from the axis of rotation of the shaft 80. The linear actuator 92 is operably connected to the shaft 80 by a crank member 94 such that the motion of the linear actuator 92 rotates the shaft 80 approximately 90 degrees between an operating position wherein the arm members 86 are substantially vertical (shown in FIG. 4A) and a loading position wherein the arm members 86 are substantially horizontal (shown in FIG. 4B).

As best shown in FIG. 2, a support tube 96 is pivotally attached to the top of the arm members 86 behind the drum portion 60 of the cryogenic chamber 52. As best shown in FIG. 4A, pins 98 extend outwardly from the support tube 96 substantially perpendicular to the longitudinal axis of the support tube 96. The pins 98 extend through openings at the top of the arm members 86 such that the support tube 96 pivots about a pivot axis 100 concentric with the axis of the pins 98, that is, substantially perpendicular to the longitudinal axis of the support tube 96.

As best shown in FIG. 2, the support tube 96 extends into the cryogenic chamber 52 through an opening 102 in the rearward end of the drum portion 60. A generally-oval shaped sealing member 104 is carried by the support tube 96 to seal the opening 102 in the drum portion 60 of the cryogenic chamber 52. The sealing member 104 is preferably made from stainless steel shim stock and formed to engage the drum portion 60 with a spring force to ensure contact between the sealing member 104 and the drum portion 60 during expansion and contraction due to large temperature changes. It is noted that the support tube 96 and barrel shaft 74 are each sized with a length adequate to dissipate the cool temperatures associated with the cryogenic chamber 52 before reaching the components located at the rearward end of the support tube 96.

Carried within the support tube 96 is the barrel shaft 74 having a rotational axis 106 coaxial with the longitudinal axis of the support tube 96. The forward end of the shaft 74 is fixed to the closed rearward end of the barrel 54 such that the barrel 54 rotates with the shaft 74. The shaft 74 is supported for rotation within the support tube 96 by graphite bushings 108 and axially engaged surfaces are provided with teflon rings 110. It is noted that the graphite bushings 108 are capable of operating at temperatures as low as −458 degrees F. Carried by a rearward end of the support tube 96 is a variable speed servo motor 112 operably connected to the barrel shaft 74 by an assembly of belts and pulleys for rotation of the barrel shaft 74 and barrel 54. Provided at the forward end of the barrel shaft 74 within the treatment chamber 72 of the barrel 54 is a thermocouple 114. Wire 116 for connecting the thermocouple 114 extends through a stationary tube at the center of the shaft 74 from the thermocouple 114 to the rear end of the shaft 74 where it is connected by suitable means to the electrical control system.

Figure 5:
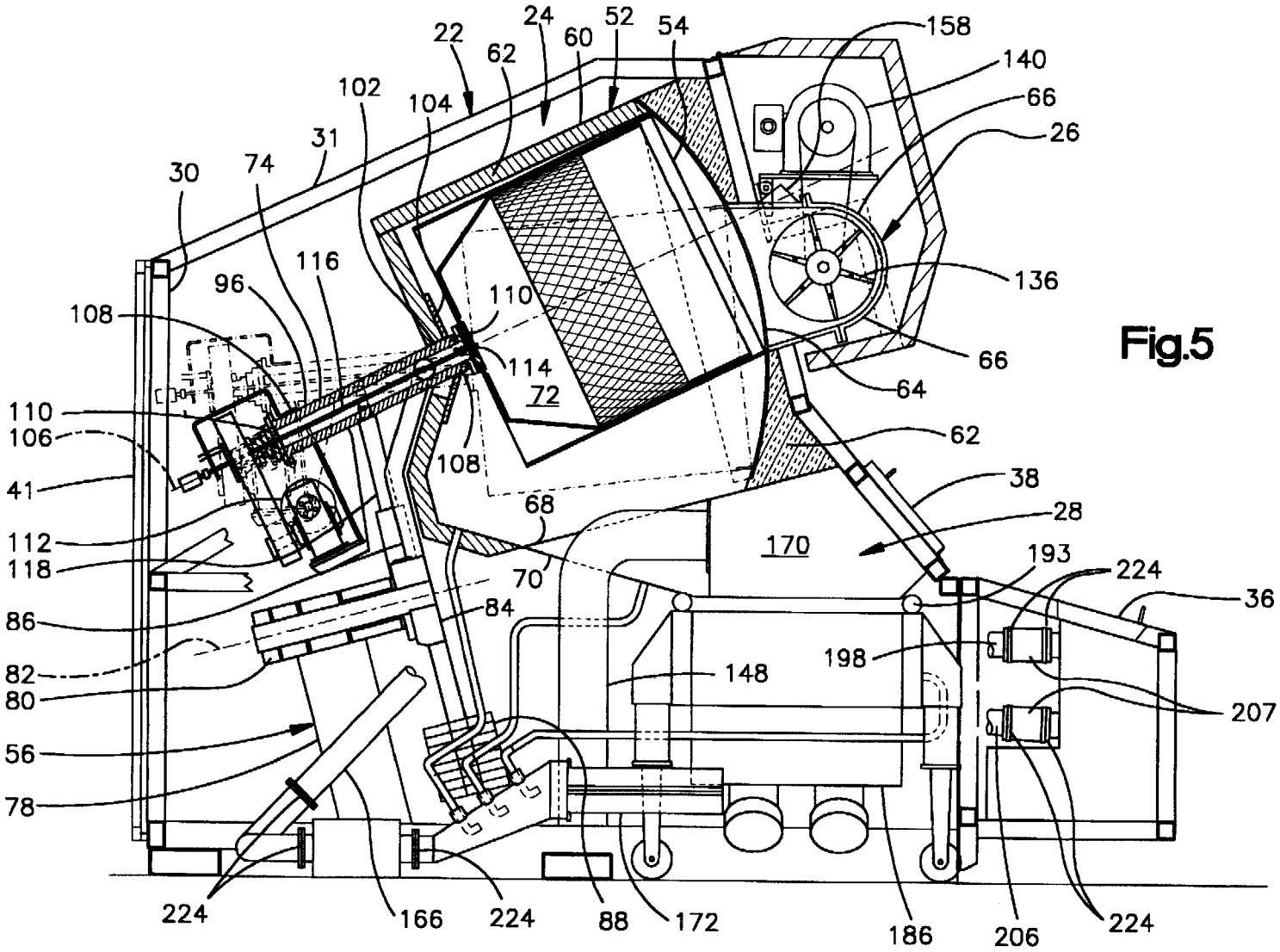
FIG. 5 is a side elevation view, in partial cross-section, similar to FIG. 2 but with the rotating barrel in a raised operating position.
Figure 6:
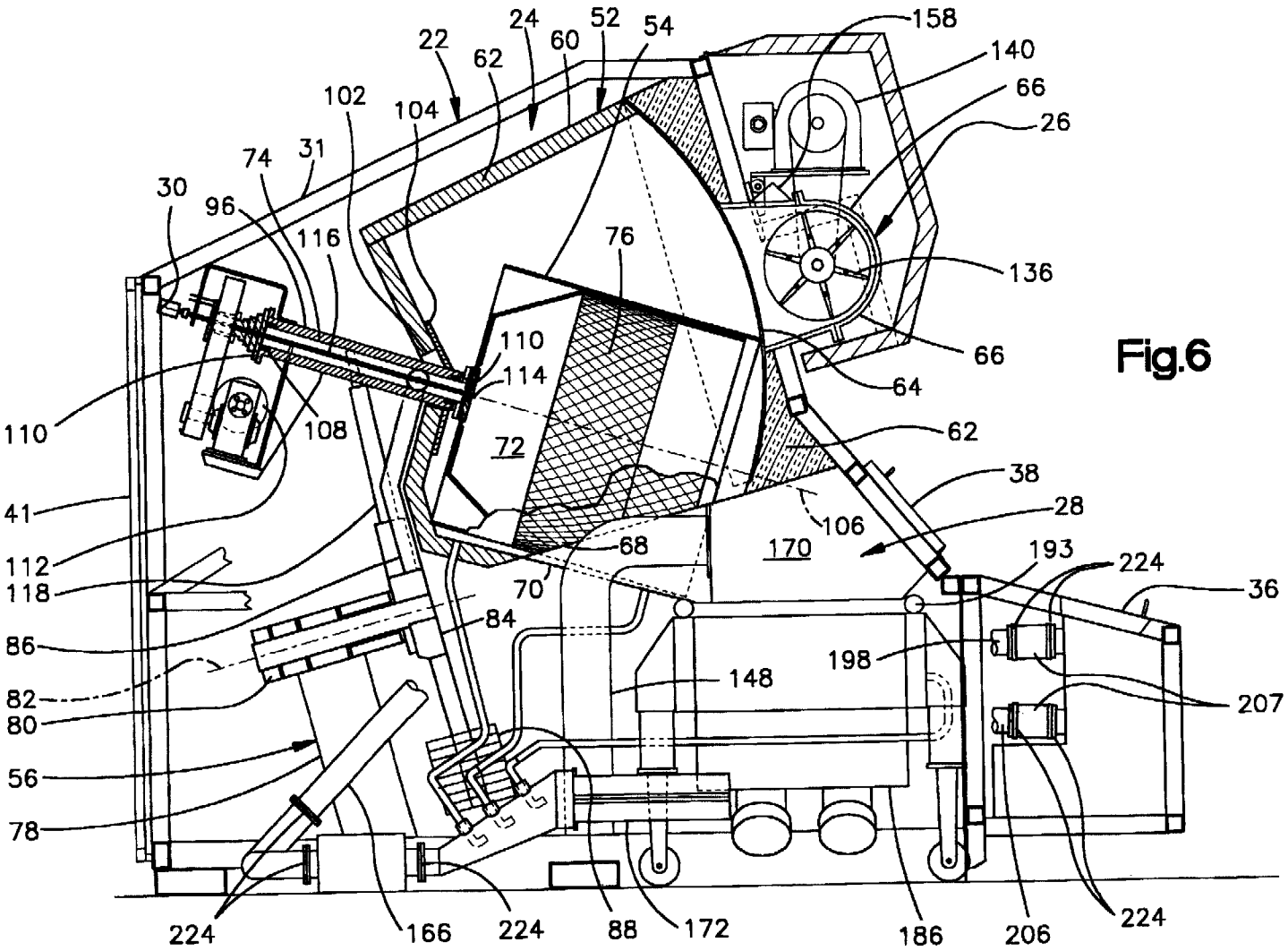
FIG. 6 is a side elevation view, in partial cross-section, similar to FIG. 2 but with the rotating barrel in a dumping position.

As best shown in FIG. 4A, a linear actuator or pneumatic cylinder 118 is provided to pivot the support tube 96 about the pivot axis 100. The linear actuator 118 is supported by the arm members 86 such that the direction of motion of the linear actuator 118 is offset from the pivot axis 100 of the support tube 96. The linear actuator 118 is operably connected to the support tube 96 by a crank member 120 such that the motion of the linear actuator 118 pivots the support tube 96 over a range extending both above and below horizontal. Preferably, the support tube 96 is pivoted over a range of about 40 degrees, which is from about 25 degrees above horizontal (shown in FIG. 5) to about 15 degrees below horizontal (shown in FIG. 6). During operation, therefore, the angle of inclination of the rotational axis 106 of the barrel 54 can be held constant at any of the angles, can step through various angles, or can continuously sweep through the various angles. It is noted that the opening 102 in the drum portion 60 of the cryogen chamber 52 is generally oval shaped to allow for the upward and downward movement of the support tube 96. Additionally, the sealing member 104 is sized such that the opening 102 remains sealed with all positions of the support tube 96.

Figure 7A:
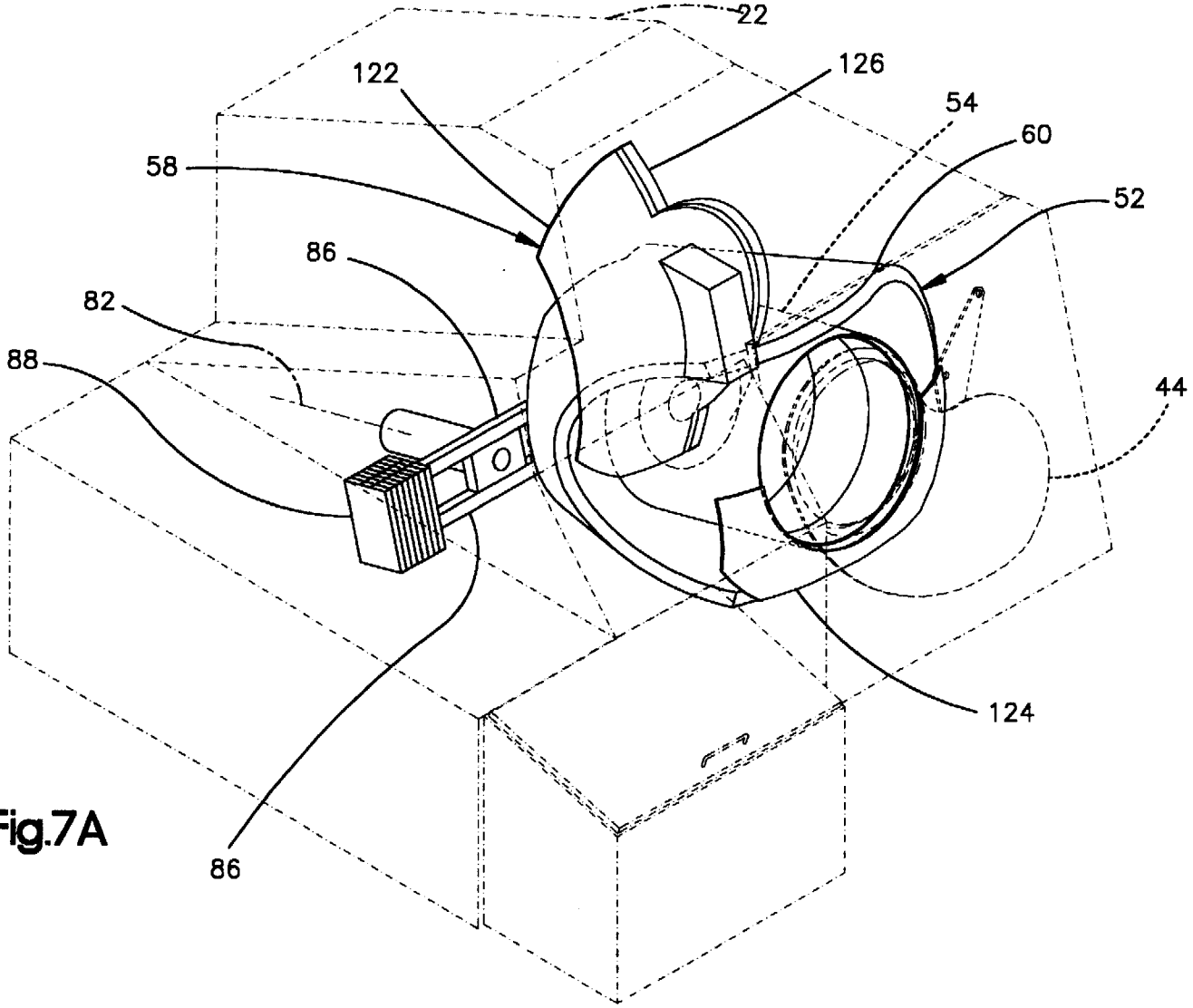
FIG. 7A is a perspective view, similar to FIG. 1, of a cryogen chamber and the barrel in the loading position.
Figure 7B:
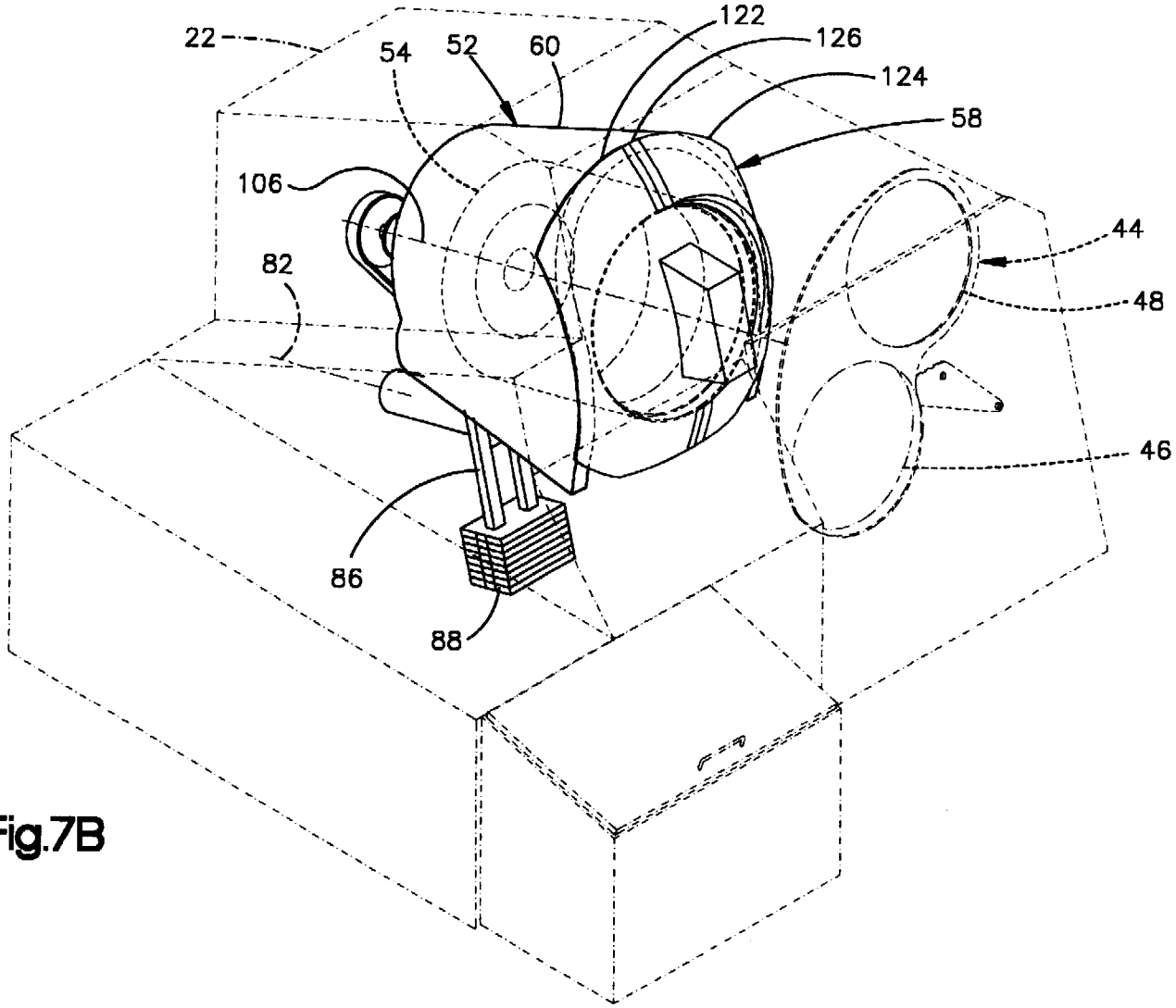
FIG. 7B is a perspective view, similar to FIG. 7A, but in the operating position.
Figure 7C:
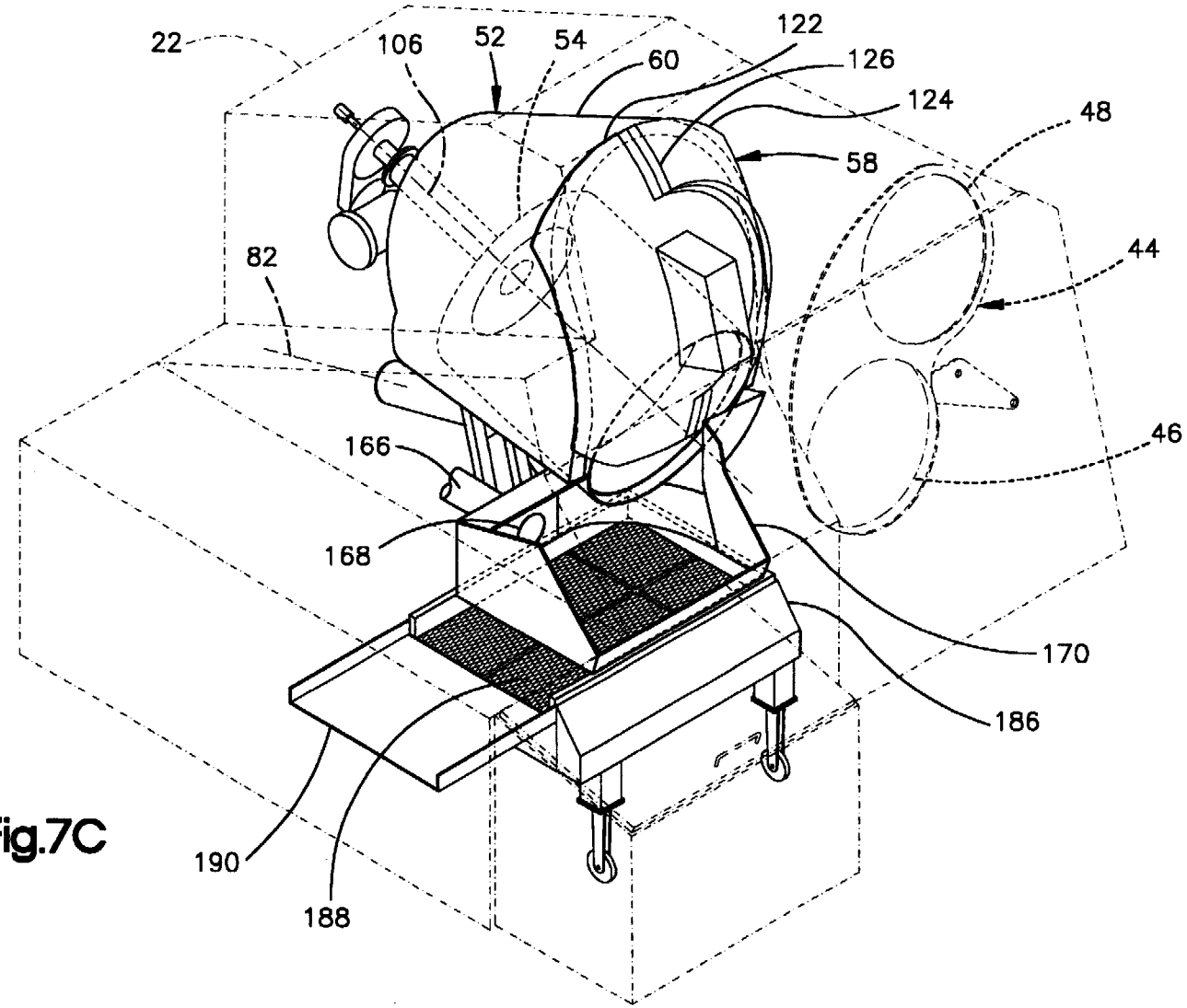
FIG. 7C is a perspective view, similar to FIG. 7B, but in the dumping position.

As best shown in FIGS. 7A–C, the dome portion 58 of the cryogen chamber 52 includes left and right sections 122, 124 to accommodate rotation of the drum portion 60 of the cryogen chamber 52 between the loading position (FIG. 7A) and the operating position (FIG. 7B). The left and right dome sections 122, 124 have a parting line which is generally vertical and straight adjacent the top and bottom of the dome portion 58 and is generally arcuate at the center. The right section 124 is supported and carried by the drum portion 60. The right section 124 is sized such that the forward open end of the barrel 54 is open for loading work pieces into the treatment chamber 72 when the drum portion 60 is in the loading position (FIG. 7A). The left section 122 of the dome portion 60 is stationary and fixed to the cabinet 22. Joint members 126 are fixed to the forward side of the left section 122 such that when the drum portion 60 is in the operating position (FIG. 7B) the left and right sections 122, 124 mate together and the joint members 126 provide a lap joint which seals the dome portion 58.

Additionally, the drum portion 60 must be separable from the drop chute 70 in order to accommodate rotation of the drum portion 60 between the loading position (FIG. 7A) and the operating position (FIG. 7B). The drum portion 60, however, is preferably hingedly attached to the drop chute 70 along the side adjacent the loading position.

Figure 8:
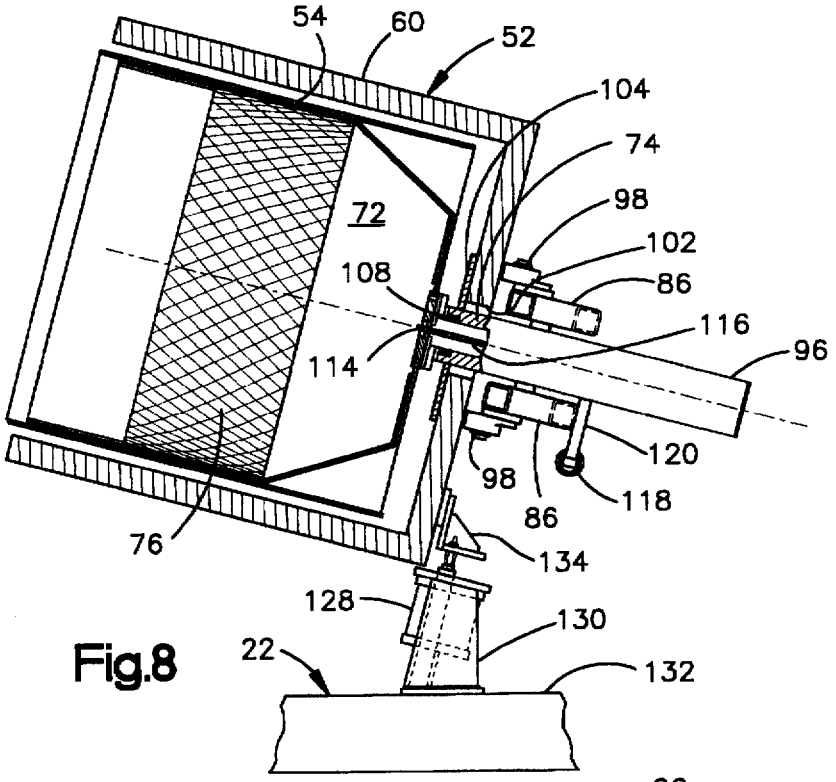
FIG. 8 is an enlarged side elevational view taken along line 8—8 of FIG. 3.

As best shown in FIG. 8, a load cell 128 is supported by a mounting bracket 130 attached to a floor 134 of the cabinet 22. An angle bracket 134 is attached to the rearward end of the drum portion 60 of the cryogen chamber 52 such that it engages the load cell 128 when the drum portion 60 is in the loading position (FIGS. 1 and 7A). The load cell 128 provides a signal representative of an increase in weight as the work pieces are loaded into the barrel 54. Therefore, the number of parts loaded into the barrel 54 can be calculated from the increase in weight and the weight of an individual work piece.

As best shown in FIG. 2, the throwing wheel assembly 26 is supported on the front wall of the cabinet 22 adjacent the opening 64 in the dome portion 58. The throwing wheel assembly 26 includes a vaned rotor 136 which is inclosed by the surrounding housing 66. As best shown in FIG. 3, a shaft 138 supports the rotor 136 for rotation, and is journalled by graphite bushings and teflon rings. A variable speed motor 140 is supported by the cabinet 22 above the rotor 136 and is drivingly connected to the shaft 138 for rotation.

Figure 9:
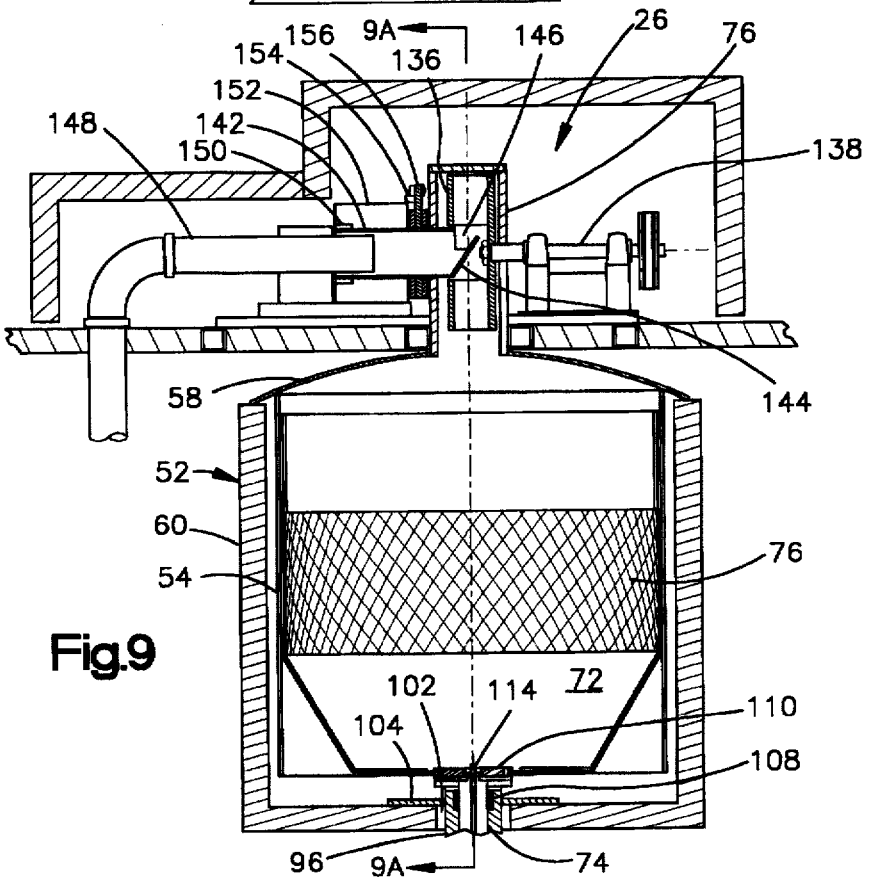
FIG. 9 is an enlarged cross-sectional view taken along line 9—9 of FIG. 2.
Figure 9A:
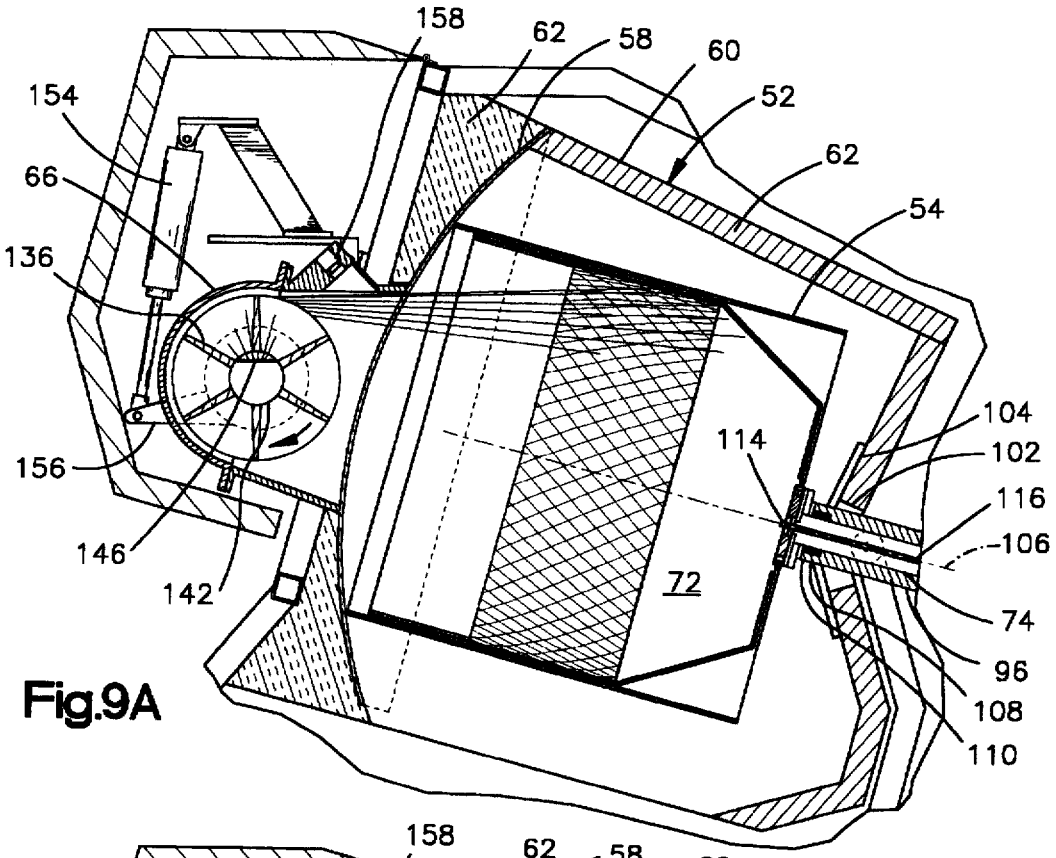
FIG. 9A is a cross-section view taken along line 9A—9A of FIG. 9 with a throwing wheel nozzle in an up position.

As best shown in FIGS. 9 and 9A, a variable nozzle 142 is provided to introduce particulate media into the rotor 136.

The particulate media is typically polycarbonate particles of a selected uniform size. The nozzle 142 is generally cylindrically shaped and concentric with the rotational axis of the rotor 136. The exit of the nozzle 142 is located within the rotor 136. An angled plate 144 at least partially closes off the end of the nozzle 142 and directs the particulate media radially outwardly through an opening 146 on one side of the nozzle 142 and onto the vanes of the rotor 136. The entrance to the nozzle 142 is connected to a supply conduit 148. The supply conduit 148 extends into the nozzle 142 to introduce particulate media gas and particulate media into the nozzle 142. Media and cryogen introduced into the vanes are caused to be projected outwardly under centrifugal force as the rotor 136 is turned by the motor 140. Thus, the throwing wheel assembly 26 operates to direct a flow of particulate media and cryogen gas from the supply conduit 148 into the barrel 54 for impacting the work pieces.

The nozzle 142 is rotatable about its longitudinal axis, which is concentric with the rotational axis of the rotor 136, to vary the orientation of the nozzle opening 146. The orientation of the opening 146 is adjusted to provide a degree of control with respect to the direction and manner in which the particulate media is discharged from the throwing wheel assembly 26 into the barrel 54. The direction of discharge of particulate media which is propelled by the throwing wheel assembly 26 can, in this manner, be adjusted to aim the particulate media toward a desired portion of the barrel.

Figure 9B:
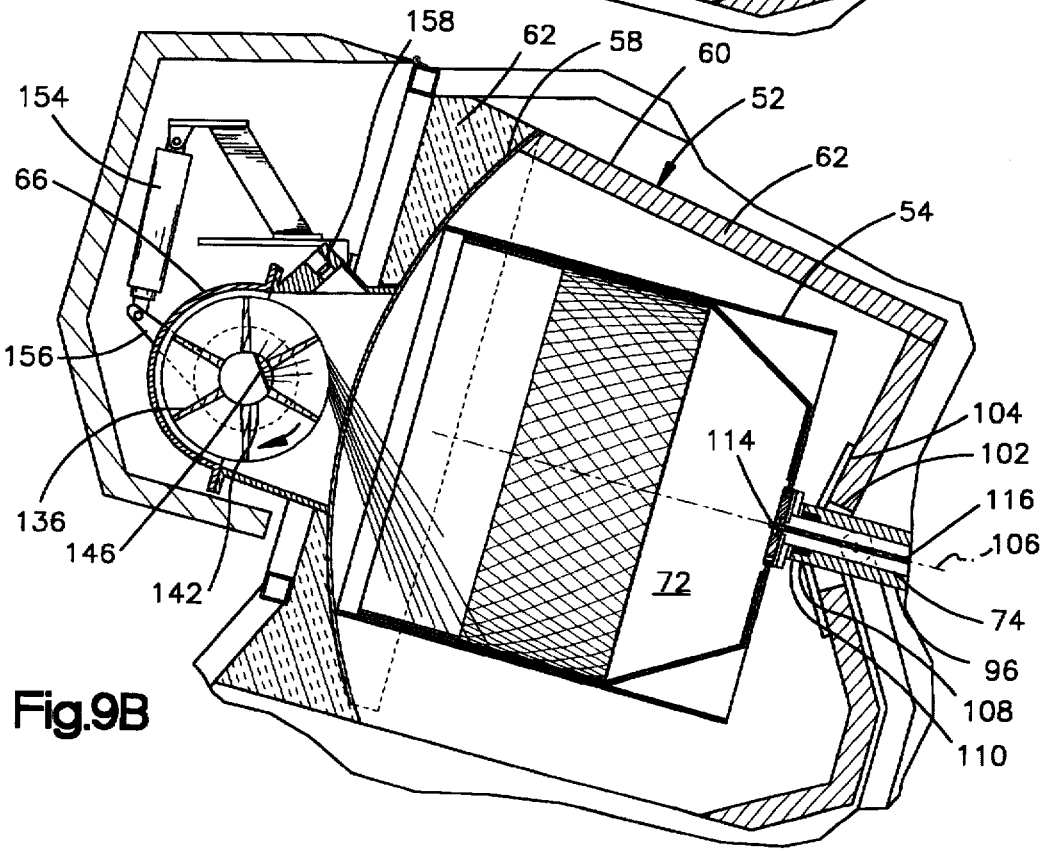
FIG. 9B is a cross-section view similar to FIG. 9A but with the throwing wheel nozzle in a down position.
Figure 10:
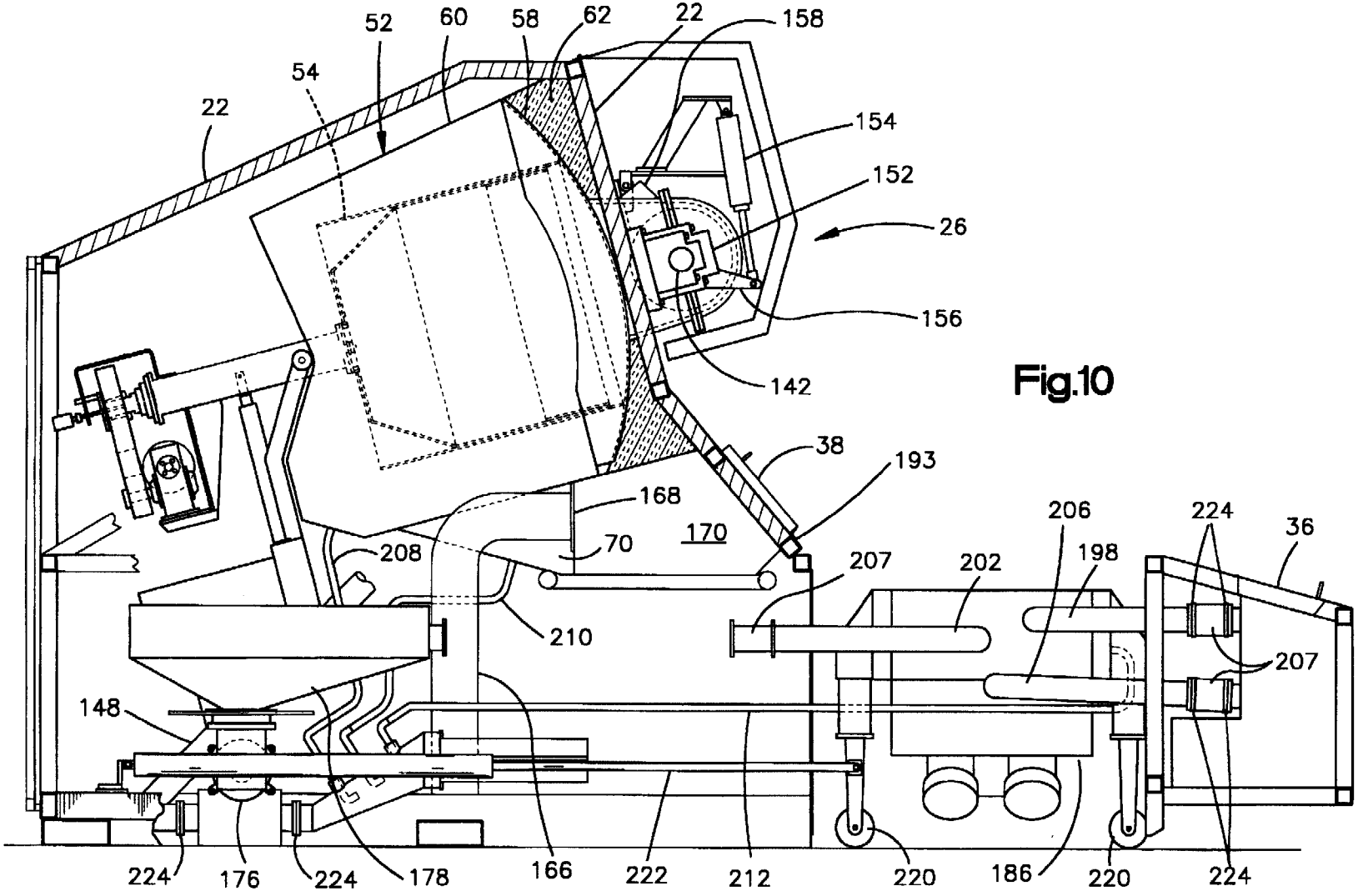
FIG. 10 is a side elevational view with a separator unit in an auxiliary position.

The nozzle 142 is rotatably supported by graphite bushings 150 and teflon rings (not shown) within a support housing 152. As best shown in FIGS. 9A and 10, the nozzle 142 is rotated by a linear actuator 154 which is supported by the cabinet 22 and is operably connected to the nozzle 142 by a crank arm 56 such that linear motion of the actuator 154 rotates the nozzle 142. As best shown in FIGS. 9A and 9B, the nozzle 142 is preferably rotatable over the full range of the barrel 54. Such as for example, between a first position where the opening 146 is facing in a generally upward direction to direct the stream of particulate media toward the top of the barrel 54 or the top of the rearward closed wall of the barrel 54 (as best shown in FIG. 9A) and a second position, about 30 degrees from the first position, where the opening 146 is generally facing the barrel to direct the stream of particulate media toward the side wall of the barrel 54 at the bottom of the treatment chamber 72 (as best shown in FIG. 9B). During operation, therefore, the angle of inclination of the flow of particulate media can be held constant at any of the angles, can step through the various angles, or can continuously sweep through the various angles.

As best shown in FIGS. 2 and 9, a cryogen nozzle 158 is located above the throwing wheel assembly 26. A valved cryogen supply conduit 160 connects the nozzle 158 with a source of pressurized cryogen 162, such as liquid nitrogen, which is maintained at a temperature that is lower than such temperature as is desired to be maintained in the treatment chamber 72 during operation of the apparatus 20. The valved conduit 160 includes a conventional power-operated valve 164 for controlling the flow of cryogen into the treatment chamber 72. The nozzle 158 is oriented to direct a two phase flow of cryogen into the barrel 54 to impact the work pieces.

Figure 12:
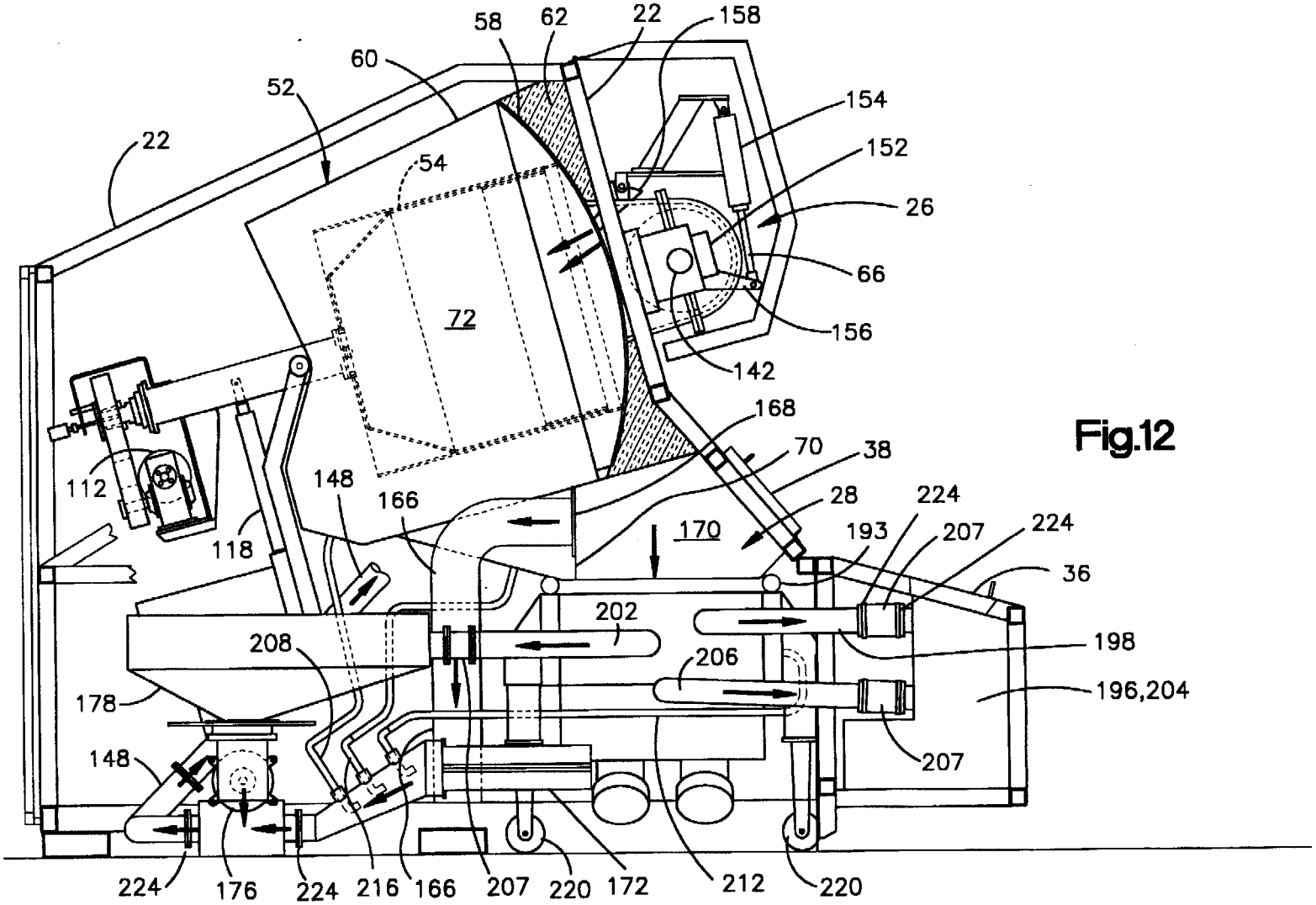
FIG. 12 is a side elevational view, similar to FIG. 2, showing various flow paths during operation of the apparatus.
Figure 13:
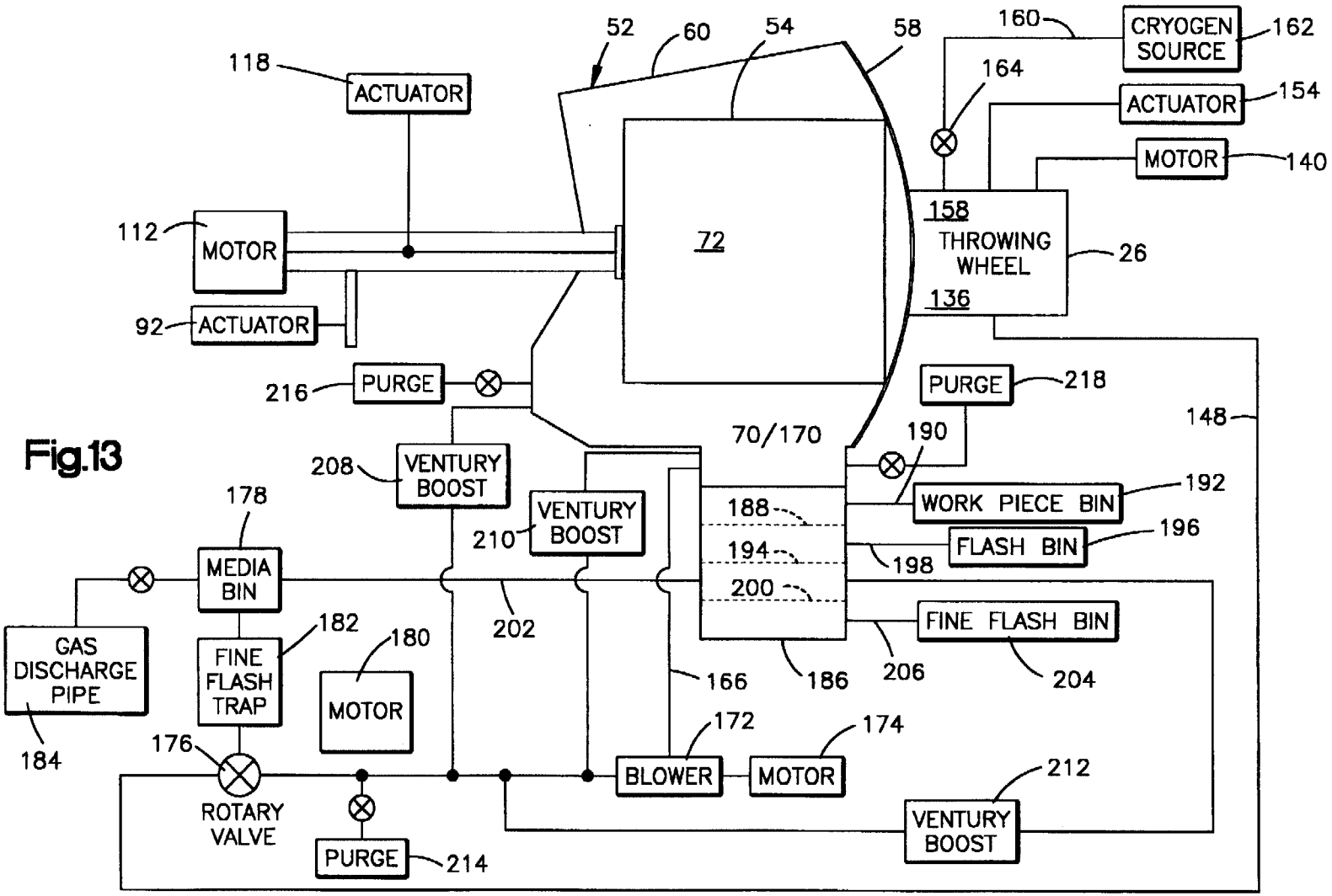
FIG. 13 is a block diagram of the cryogen shot blast deflashing apparatus according to the invention.

As best shown FIG. 12 and diagrammatically illustrated in FIG. 13, the closed recirculation system 28 includes the supply conduit 148 and also a return or withdrawal conduit 166. The withdrawal conduit 166 connects a sealed plenum chamber 170, which is in communication with the cryogen chamber 52 through the drop chute 70, with a blower 172. The withdrawal conduit is connected to an exit 168 located at the back of the plenum chamber 170. The blower 172 evacuates cryogen gas from the withdrawal conduit 166 and delivers pressurized cryogen gas to the supply conduit 148. The supply conduit 148 returns the cryogen gas to the throwing wheel assembly 26. A variable speed drive motor 174 is provided for driving the blower 172. The blower 172 operates in a push-pull fashion to establish a high velocity flow of cryogen gas through the treatment chamber 72 by diminishing pressure within the withdrawal conduit 166 to effectively evacuate gas from the cryogen chamber 52 and also by pressurizing the cryogen gas for delivery under pressure to the cryogen chamber 52 through the supply conduit 148 and the throwing wheel assembly 26.

A metering or rotary valve 176 is interposed in the supply conduit 148 for introducing a controlled flow of particulate media from a media hopper or bin 178 into the flow of pressurized cryogen gas which is being delivered by the supply conduit 148 to the throwing wheel assembly 26. The metering valve 176 includes a vaned rotor which is driven by a variable speed motor 180 for dispensing a controlled flow of particulate media into the supply conduit 148. The particulate media is fed into the rotary valve 176 from the media bin 178 by gravity. A fine flash trap 182 is located between the rotary valve 176 and the media bin 178 to trap fine flash by a pressure drop to prevent fine flash from entering the media bin 178. The media bin 178 is also connected to a cryogen gas discharge pipe 184 for discharging cryogen gas from the system 28 when desired.

The closed recirculation system 28 also includes a vibratory separator unit 186 for separating work pieces, flash, and particulate media. The separator unit 186 has a first screen 188 which effectively removes the work pieces to a drop chute or tray 190 (FIG. 1) which deposits the work pieces into a work piece bin 192 located adjacent the work piece access door 34. The separator unit is located below the plenum chamber 170 such that the first screen 188 forms the bottom of the plenum chamber 170. A brush or gasket 193 attached to the top separator unit 186 provides a seal between the separator unit 186 and the plenum chamber 170. The first screen 188 preferably has openings of about ¼ inch. A second screen 194 effectively removes large particles of flash for delivery to a flash bin 196, located adjacent the flash access door 36, through a conduit 198. The second screen 194 preferably is of No. 1 market grade, that is, has openings of about 0.073 inches. A third screen 200 effectively removes reusable particulate media for delivery to the media hopper 178, located adjacent the media access door 32, through a conduit 202. The third screen 200 preferably is 32 Tensile Bolt Cloth, that is, has openings of about 0.024 inches. It is noted, however, that each of the screens 188, 194, 200 are changeable. Smaller particles of flash and other waste particles pass through the third screen 200 and are delivered to a fine flash bin 204, also located adjacent the flash access door, through a conduit 206. A conventional vibratory system (not shown) is provided for effectively vibrating the separation unit 186 to separate the particulate within the different stages. Each of the conduits 198, 202, and 206 which are attached to the separator unit 186 are connected with a flexible coupling 207 to allow the vibrational movement of the separator unit 186.

Figure 11:
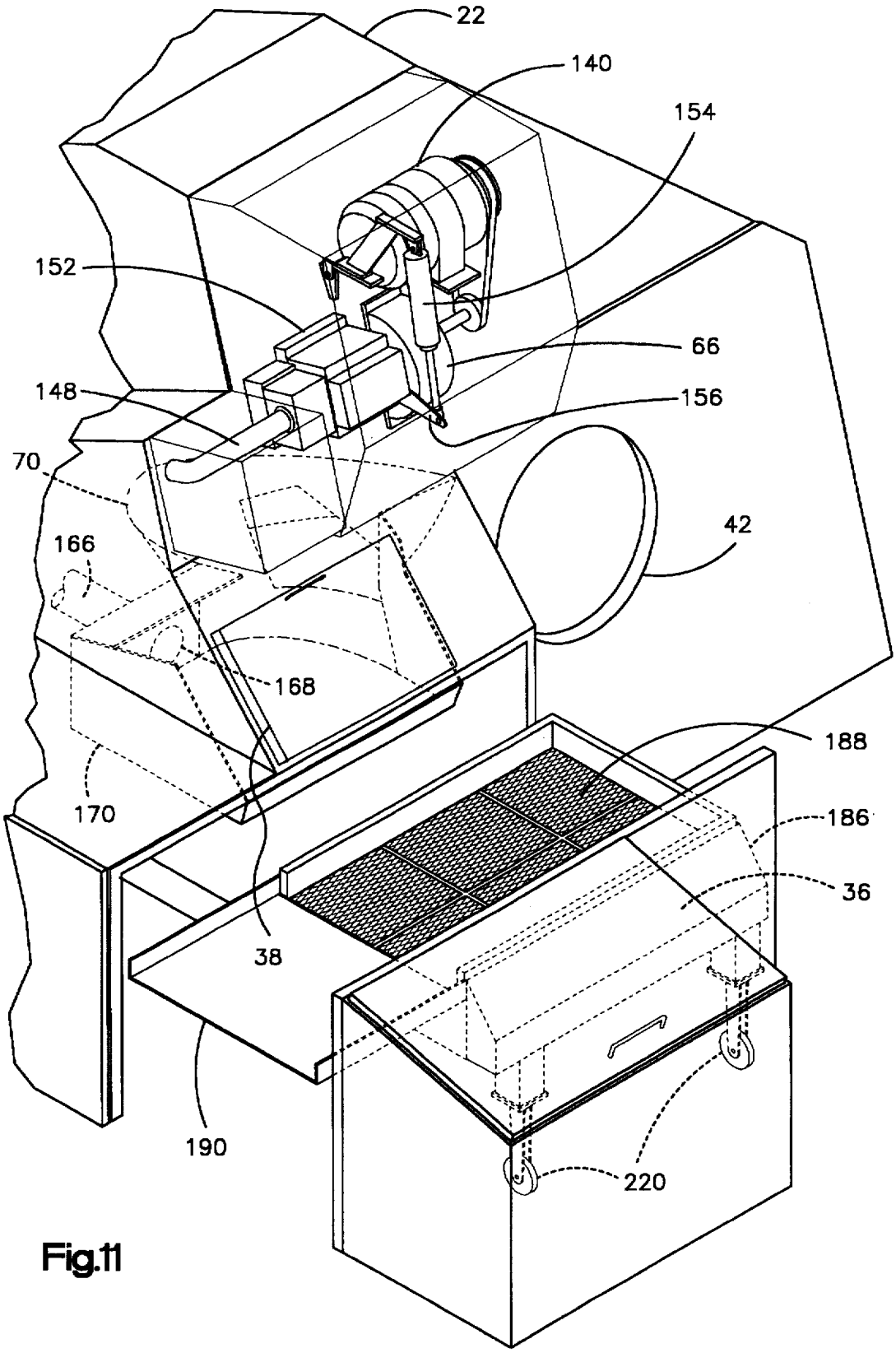
FIG. 11 is a perspective view of the separator unit in the auxiliary position.

As best shown in FIGS. 10 and 11, the separator unit 186 is mounted on rollers so that the separator unit 186 can be moved forward away from the cabinet 22. In this auxiliary position, the top screen 188 is exposed and the separator unit 186 can be utilized for other operations. In the illustrated embodiment, the conduit 202 connecting the media bin 178 is disconnected prior to the forward movement of the separator unit 186. A linear actuator or hydraulic cylinder 220 (FIG. 10) is provided to move the separator unit 186. It is noted that the flash bin 196 and fine flash bin 204 are supported by the separator unit 186 and moved along with the separator unit 186.

Venturi boost systems 208, 210, 212 are also provided within the closed recirculation system 28. The illustrated apparatus 20 includes three venturi boost systems 208, 210, 212. A fewer or greater number, however, could be utilized within the scope of the present invention. Each venturi boost system 208, 210, 212 includes an inlet located in the supply conduit 148 between the blower 122 and the rotary valve 176. The first venturi system 208 has an outlet at the bottom of the drum portion of the cryogen chamber 52 near the rearward end. The second venturi boost system 210 has an outlet in the bottom surface of the drop chute 70. The third venturi boost system 212 has an outlet at the separator unit 186 above the second screen 194. Each venturi boost system 208, 210, 212 receives a relatively high velocity flow of cryogen gas from the supply conduit 148 and passes the flow through a venturi nozzle to further increase the velocity of the flow. The flow of cryogen gas is then reinjected through the outlets at the various points within the closed recirculation system 26 to assist or boost the flow of particulate media. The venturi boost systems 208, 210, 212 substantially increase the flow rate of particulate media through the recirculation system 28 by increasing the flow of particulate media and preventing the particulate media from accumulating at various points within the system 28. It is noted that, alternatively, the venturi boost systems can be connected to a source of pressurized shop air to boost the particulate matter with a stream of pressurized air.

Purge lines 214, 216, 218 are provided at a series of locations along the closed recirculation system 28 to insert an inert purging gas, such as nitrogen, into the system 28. The purging gas maintains a positive pressure in the closed recirculation system 28 so that moisture containing ambient air is kept out. See U.S. Pat. No. 4,646,484, the disclosure of which is expressly incorporated herein in its entirety by reference, for a detailed description of purging system for a cryogen shot blast deflashing system. The illustrated apparatus 20, includes three purge lines 214, 216, 218. It is noted that a fewer or greater number of purge lines could be utilized and/or could be located at different locations. The first purge line 214 is located in the supply conduit 148 between the blower 172 and the rotary valve 176. The second purge line 216 is located at the rearward end of the drum portion 60 of the cryogenic chamber 52. The third purge line is located at the plenum chamber 170. Preferably, a fourth purge line is located in the wall of the cabinet 22.

It is noted that because the supply and withdrawal conduits 148, 166 connect stationary members, the throwing wheel assembly 26 and the media bin 178 respectively, to the blower 172. The conduits 148, 166, therefore can be relatively rigid such as, for example stainless steel tubes. Flexible and articulating components, which are relatively expensive, are thereby not required.

Figure 14B:
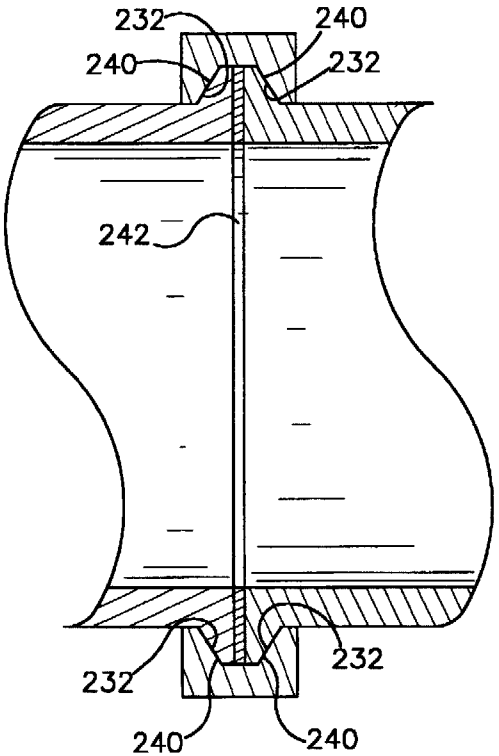
FIG. 14B is a cross-sectional view taken along line 14B—14B of FIG. 14A.
Figure 14A:
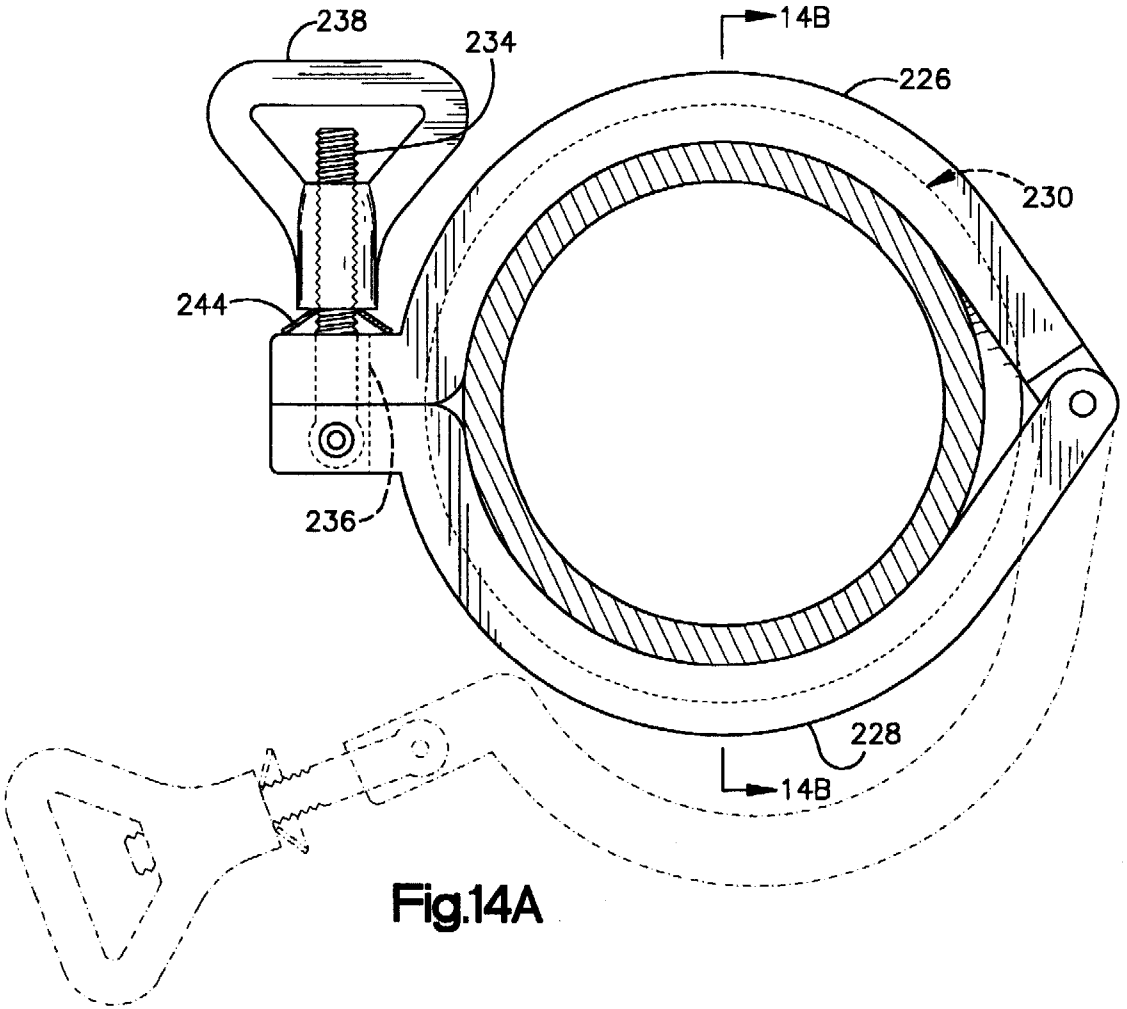
FIG. 14A is side elevational view, in partial cross-section, of a tri-clover fitting clamping together to section of conduit.

Each element of the conduits 148, 166, 198, 202, 206 of the closed recirculation system 28 are connected with 3A dairy standard tri-clover fittings 224 which have been found to provide a cryogenic gas seal. As best shown in FIGS. 14A and 14B, each fitting 224 has a pair of clamping members 226, 228 which are hinged together. Together the clamping members 226, 228 form a circular groove 230 having angled side surfaces 232. A threaded member 234 is pivotally attached to one of the clamping members 228 and pivots to a position extending through a slot 236 on the other clamping member 226. A compression head 238 is threaded onto the threaded member 234 to apply a compressive force to clamp the members 228, 226 together. Flanges 240 of the conduits to be connected are located within the circular groove 230 and engage the angled side surfaces 232. A silicone gasket is provided between the flanges 240. The angled side surfaces 232 and the silicone gasket 242 ensure that a seal is maintained between the flanges 240 of the conduits even if the clamping members 226, 228 shrink due to the low temperatures of the cryogen gas. Preferably, a belleville washer 244 is provided below the compression head to insure that a compressive force is maintained if the clamping members 226, 228 shrink due to the low temperatures of the cryogen gas.

Various operating parameters of the apparatus 20 are preferably predetermined through experimentation as being optimum for particular work pieces to be deflashed. To the degree that these parameters are adjustable by operator controls, the optimum parameters are preferably preprogrammed into a microprocessor based controller which automatically carries out the operation according to the optimum parameters.

During a deflashing operation, the barrel 54 is initially rotated to the loading position (FIGS. 1 and 7A) and the loading door 44 is moved such that the open portion 46 is adjacent the opening 42 in the cabinet 22. A charge of work pieces to be deflashed is input into the barrel 54 through the opening 42. As the work pieces are input into the barrel 54, a signal representative of the weight of the work pieces is sent by the load cell 128 to the controller which determines when a desired number work pieces have been input into the barrel 54 based on a preprogrammed individual work piece weight. The controller can also advantageously determine a total deflashing cost per work piece by recording the total number of parts and total amount of cryogen and power used during the operation. The loading door 44 is then moved such that the closed portion 48 is adjacent the opening 42 in the cabinet 22 and the barrel 54 is rotated to the operating position (FIGS. 2 and 7A) where the barrel 54 is in the sealed cryogenic chamber 52.

Initially, a pre-chill cycle cools the work pieces down to a desired temperature. Cryogen is introduced into the treatment chamber 72 through the valved conduit 160 and nozzle 158 and operation of the blower 172 is initiated to circulate cryogen gas through the closed recirculation system 28 to prechill the work pieces such that they are ready for a deflashing operation. No particulate media, however, is being introduced during this pre-chill cycle. Operating parameters preprogrammed into the controller for the pre-chill cycle include: (1) duration of the cycle; (2) direction of rotation of the barrel (run forward or reverse, or jog forward, reverse, or alternating); (3) speed of rotation of the barrel; (4) angle of inclination of the barrel; and (5) temperature within the barrel (controlled by cryogen flow).

At the completion of the pre-chill cycle, a deflashing cycle begins. During the deflashing cycle, both cryogen and particulate media is introduced into the barrel 54 to impact the work pieces. A flow of cryogen gas and particulate media is delivered through the supply conduit 148 to the throwing wheel assembly 26. The throwing wheel assembly 26 projects a relatively high velocity flow of cryogen gas and particulate media into the treatment chamber 72 to impact the work pieces as the barrel 54 is rotated to impart a tumbling action to the work pieces so that all flash-carrying surfaces of the work pieces are exposed to the embrittling affect of the cryogen and the impact of the particulate media.

It has been found that the required duration of the deflashing cycle can be substantially reduced by simultaneously varying the inclination angle of the barrel 54 and the direction of the flow of the particulate media from the throwing wheel assembly 26 while the barrel 54 is rotating. The inclination angle of the barrel 54 is varied by pivoting the support tube 96 by means of the actuator 118. The direction of flow of the particulate media is varied by rotating the nozzle 142 by means of the actuator 154.

During rotation of the barrel 54, a flow of particulate (both flash and particulate media) discharges from the treatment chamber 72 through the openings 76 in the barrel 54 into the cryogenic chamber 52, through the drop chute 70 and onto the separator unit 186. At the same time, cryogen gas discharges from the treatment chamber 72 through the openings 76 in the barrel 54 to the cryogenic chamber 52, through the drop chute 70 to the plenum chamber 170, into the withdrawal conduit 166 through the plenum chamber exit 168, and to the blower 172. The blower 172 pressurizes the withdrawn cryogen gas and ducts it into the supply conduit 166 through which it travels at a relatively high velocity back to the throwing wheel assembly 26. The separator unit 186 separates reusable particulate media and ducts it into the media hopper 178, from where the particulate media flows under the influence of gravity, and controlled by the metering valve 176, into the supply conduit 148 for return to the throwing wheel assembly 26. Waste particulate including pieces of flash and the like are ducted by the separator unit 186 into the flash bins 192, 204.

Operating parameters preprogrammed into the controller for the deflashing cycle include: (1) duration of cycle; (2) direction of rotation of the barrel (run forward or reverse); (3) speed of the barrel (0–235 ft/min); (4) angle of inclination of the barrel and duration (set or sweeping); (5) separator unit vibration speed; (percent of maximum); (6) rotational speed of the throwing wheel (up to 6000 rpm); (7) flow rate of media introduced (up to 1200 lb/hr); (8) orientation and duration of the variable nozzle and duration (set or sweeping) and (8) temperature within the barrel and duration (down to −220 degrees F.).

At the completion of the deflashing cycle, a post-tumble cycle begins. The flow of cryogen, cryogen gas, and particulate media is stopped. The barrel 54, however, continues to rotate and the separator unit 186 continues to separate particulate falling from the barrel 54. Operating parameters preprogrammed into the controller for the post-tumble cycle include the duration of the cycle (typically 1–2 minutes but can be up to 30 minutes).

At the completion of the post-tumble cycle, a dump cycle begins. During the dump cycle, the barrel 54 is pivoted forward to a dumping position (FIGS. 6 and 7C) so that the contents are dumped onto the separator unit 186 whereupon the deflashed work pieces are discharged into a work piece bin 192 which can be removed through the work piece access door 34. In preferred practice, the door 34 is kept open for as short a time as possible to minimize the escape of cryogen gas and to minimize the entry of ambient moisture. Operating parameters preprogrammed into the controller for the dump cycle include: (1) rotational speed of the barrel; (2) angle of inclination of the barrel and duration; (3) additional angles of inclination of the barrel and duration (to control the exit of the work pieces) (4) unload time for the door (limit moisture intake).

If desired, a drying cycle can begin after the dumping cycle to dry the particulate media. After the work pieces are removed, the barrel 54 is returned to an operating position (FIGS. 2 and 7B) and the particulate media is circulated through the closed recirculation system. The circulation of the particulate media and gas or air thereby dries the particulate media. When an additional deflashing operation is desired, the above-described procedure is repeated.

The illustrated apparatus can also be advantageously operated to both tumble and deflash work pieces in a shorter period of time than would be required for separate operations in a tumbling apparatus and a deflashing apparatus. The combined tumble and deflash operation is as described above for a deflashing operation except that tumbling media is inserted into the barrel 54 along with the work pieces. Additionally, the first screen 188 of the separator unit is replaced with a bar grate so that the tumbling media will pass through to the flash bin 196. Alternatively, a bar grate can be placed between the tray 190 and the work piece bin 192 outside the work piece access door 34. The remainder of the combined operation is as described-above for the deflashing operation. It is noted that the tumbling media can advantageously be rubber elements, either molded to a particular weight and shape or old junk parts. The rubber elements can be sized and shaped to have a warmer embrittlement temperature than prior art tumbling media.

As will be apparent from the foregoing description, the system of the present invention has novel and improved features that include advances in both method and apparatus. The system includes a significant number of simplifications and more efficient arrangement and utilization of components as compared with prior art devices. In operational tests, the system has been found to carry out deflashing procedures expeditiously and reliably with a wide variety of different types of work pieces.

Although particular embodiments of the invention have been described in detail, it will be understood that the invention is not limited correspondingly in scope, but includes all changes and modifications coming within the spirit and terms of the claims appended hereto.

What is claimed is:

1. A cryogen shot blast apparatus for deflashing work pieces, said apparatus comprising:

a sealed cryogenic chamber having a stationary portion;

a barrel supported within said cryogenic chamber and rotatable about a longitudinal axis, said barrel having an open end and defining a treatment chamber for the work pieces;

a throwing wheel secured to said stationary portion of said cryogenic chamber and adapted to propel particulate media into the treatment chamber to impact the work pieces in the treatment chamber;

a cryogen supply system for introducing a flow of cryogen into the treatment chamber for embrittling at least selected portions of the work pieces in the treatment chamber;

a recirculation system including a return conduit connected to said stationary portion of said cryogenic chamber and in communication with the treatment chamber, a supply conduit in communication with said throwing wheel, and a blower connected to said return conduit for withdrawing cryogen gas from the treatment chamber and connected to said return conduit to return pressurized cryogen gas to said throwing wheel; and a particulate media supply system for introducing a metered flow of particulate media into the flow of cryogen gas in said return conduit to transport the particulate media to said throwing wheel.

2. The cryogen shot blast apparatus according to claim 1, wherein said cryogenic chamber has a movable portion jointed to said stationary portion such that said barrel and said movable portion of said cryogenic chamber are movable between a loading position wherein the work pieces can be inserted into the open end of the barrel and an operating position wherein said barrel is sealed within said cryogenic chamber.

3. The cryogen shot blast apparatus according to claim 1, wherein said return and supply conduits are generally rigid and non-articulating.

4. The cryogen shot blast apparatus according to claim 1, wherein said return and supply conduits are connected with 3A dairy standard tri-clover fittings.

5. The cryogen shot blast apparatus according to claim 1, further comprising a load cell located outside said cryogenic chamber and cooperating with said cryogenic chamber for determining a weight of the work pieces in said treatment chamber.

6. The cryogen shot blast apparatus according to claim 1, wherein said cryogenic chamber includes a drum and a generally hemispherically-shaped dome at one end of said drum, said open end of said barrel facing said dome of said cryogenic chamber.

7. The cryogen shot blast apparatus according to claim 6, wherein said cryogenic chamber has a movable portion jointed to said stationary portion such that said movable portion of said cryogenic chamber and said barrel are movable between a loading position wherein the work pieces can be inserted into the open end of the barrel and an operating position wherein said barrel is sealed within said cryogenic chamber.

8. The cryogen shot blast apparatus according to claim 7, wherein said stationary portion of said cryogenic chamber includes at least a portion of said dome.

9. The cryogen shot blast apparatus according to claim 8, wherein said movable portion of said cryogenic chamber includes a portion of said dome attached to said drum.

10. The cryogen shot blast apparatus according to claim 1, wherein said barrel is pivotable relative to said cryogenic chamber about a pivot axis generally perpendicular to said longitudinal axis such that an angle of said longitudinal axis relative to horizontal is variable.

11. The cryogen shot blast apparatus according to claim 1, wherein said throwing wheel includes a vaned rotor and an articulated nozzle for injecting the particulate media into variable locations of said vaned rotor during operation of said throwing wheel to vary a direction of flow of the particulate media propelled by said throwing wheel.

12. The cryogen shot blast apparatus according to claim 11, wherein said barrel is pivotable relative to said cryogenic chamber about a pivot axis generally perpendicular to said longitudinal axis such that an angle of said longitudinal axis relative to horizontal is variable.

13. The cryogen shot blast apparatus according to claim 1, wherein tumbling media is located within said treatment chamber with said work pieces.

14. The cryogen shot blast apparatus according to claim 1, further comprising a particulate media recirculation system which withdraws reusable media from the treatment chamber and returns said reusable particulate media to said particulate media supply system, said particulate media recirculation system including a separator unit to separate the reusable particulate media from flash removed from said work pieces, said separator unit being movable between an operating position wherein a top screen of said separator unit is in communication with said treatment chamber and an auxiliary position wherein said top screen said separator unit is exposed.

15. The cryogen shot blast apparatus according to claim 1, wherein said particulate media supply system includes a rotary valve connected to said return conduit for introducing the metered flow of particulate media into the flow of cryogen gas in said return conduit, a particulate media hopper connected to the rotary valve, and a flash trap located between said particulate media hopper and said rotary valve to substantially prevent flash from entering said media hopper from said return conduit.

16. The cryogen shot blast apparatus according to claim 1, wherein said recirculation system includes a venturi boost system for injecting a high pressure stream of gas to increase a flow rate of the particulate media.

17. The cryogen shot blast apparatus according to claim 16, wherein said venturi boost system includes an inlet in the supply conduit.

18. The cryogen shot blast system according to claim 16, wherein said venturi boost system includes an outlet at a bottom of said cryogen chamber.

19. A cryogen shot blast apparatus for deflashing work pieces, said apparatus comprising:

a barrel rotatable about a longitudinal axis and defining a treatment chamber for the work pieces;

a throwing wheel adapted to propel particulate media into the treatment chamber to impact the work pieces in the treatment chamber, said throwing wheel including a vaned rotor and an articulated nozzle for continuously injecting the particulate media into variable locations of said vaned rotor during uninterrupted operation of said throwing wheel to vary a direction of flow of the particulate media propelled by said throwing wheel;

a cryogen supply system for introducing a flow of cryogen into the treatment chamber for embrittling at least selected portions of the work pieces in the treatment chamber;

a recirculation system including a return conduit in communication with the treatment chamber, a supply conduit in communication with said throwing wheel, and a blower connected to said return conduit for withdrawing cryogen gas from the treatment chamber and connected to said return conduit to return pressurized cryogen gas to said throwing wheel; and a particulate media supply system for introducing a metered flow of particulate media into the flow of cryogen gas in said return conduit to transport the particulate media to said throwing wheel.

20. The cryogen shot blast apparatus according to claim 19, wherein said barrel is pivotable relative to said cryogenic chamber about a pivot axis generally perpendicular to said longitudinal axis such that an angle of said longitudinal axis relative to horizontal is variable.

21. A cryogen shot blast apparatus for deflashing work pieces, said apparatus comprising:

a barrel rotatable about a longitudinal axis and defining a treatment chamber for the work pieces;

a throwing wheel adapted to propel particulate media into the treatment chamber to impact the work pieces in the treatment chamber, said throwing wheel including a vaned rotor and an articulated nozzle for injecting the particulate media into variable locations of said vaned rotor during operation of said throwing wheel to vary a direction of flow of the particulate media propelled by said throwing wheel, said throwing wheel further including a linear actuator connected to the articulated nozzle to move the nozzle;

a cryogen supply system for introducing a flow of cryogen into the treatment chamber for embrittling at least selected portions of the work pieces in the treatment chamber;

a recirculation system including a return conduit in communication with the treatment chamber, a supply conduit in communication with said throwing wheel, and a blower connected to said return conduit for withdrawing cryogen gas from the treatment chamber and connected to said return conduit to return pressurized cryogen gas to said throwing wheel; and a particulate media supply system for introducing a metered flow of particulate media into the flow of cryogen gas in said return conduit to transport the particulate media to said throwing wheel.

* * * * *